US008122860B2

(12) United States Patent
Kamiyama et al.

(10) Patent No.: US 8,122,860 B2
(45) Date of Patent: Feb. 28, 2012

(54) VARIABLE COMPRESSION RATIO INTERNAL COMBUSTION ENGINE

(75) Inventors: Eiichi Kamiyama, Mishima (JP); Masaaki Kashiwa, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 684 days.

(21) Appl. No.: 12/226,321

(22) PCT Filed: Apr. 27, 2007

(86) PCT No.: PCT/IB2007/001091

§ 371 (c)(1),
(2), (4) Date: Oct. 15, 2008

(87) PCT Pub. No.: WO2007/125399

PCT Pub. Date: Nov. 8, 2007

(65) Prior Publication Data

US 2009/0101113 A1 Apr. 23, 2009

(30) Foreign Application Priority Data

May 1, 2006 (JP) ..... 2006-127898
May 1, 2006 (JP) ..... 2006-127899

(51) Int. Cl.
*F02B 75/04* (2006.01)

(52) U.S. Cl. ..... 123/48 C; 123/48 R; 123/48 B; 123/78 R; 123/78 C; 123/78 B

(58) Field of Classification Search ..... 123/48 R, 123/78 R, 48 AA, 48 B, 78 B, 78 BA, 48 C, 123/78 C See application file for complete search history.

(56) References Cited

U.S. PATENT DOCUMENTS

| | | | | |
|---|---|---|---|---|
| 4,805,571 | A * | 2/1989 | Humphrey | 123/316 |
| 6,260,532 | B1 * | 7/2001 | Mendler | 123/192.2 |
| 2002/0050252 | A1 * | 5/2002 | Moteki | 123/48 B |
| 2004/0211374 | A1 * | 10/2004 | Kamiyama | 123/78 R |
| 2005/0028760 | A1 * | 2/2005 | Akihisa et al. | 123/48 R |
| 2005/0087155 | A1 | 4/2005 | Kikori | |
| 2008/0022982 | A1 | 1/2008 | Kamiyama | |

FOREIGN PATENT DOCUMENTS

| | | |
|---|---|---|
| EP | 1 526 265 A2 | 7/2005 |
| EP | 1 471 233 B1 | 8/2006 |
| JP | A-2003-206771 | 7/2003 |
| JP | A-2005-113839 | 4/2005 |
| WO | WO 2006/078079 A1 | 7/2006 |

* cited by examiner

*Primary Examiner* — Noah Kamen
*Assistant Examiner* — Long T Tran
(74) *Attorney, Agent, or Firm* — Oliff & Berridge, PLC

(57) ABSTRACT

A variable compression ratio internal combustion engine rotates a camshaft to cause relative movement between a crankcase and a cylinder block. The camshaft has a shaft member, a cam member fixed to the shaft member, and a movable bearing member rotatable with respect to the shaft member. The cam member is rotatably housed in a cam housing hole formed in the crankcase, and the movable bearing member is rotatably housed a bearing housing hole formed in the cylinder block.

23 Claims, 12 Drawing Sheets

3
2
5
c
a
b
4
9
8
9c
9a
9b
b, c
5, 8
9b, 9c

VARIABLE COMPRESSION RATIO INTERNAL COMBUSTION ENGINE

BACKGROUND OF THE INVENTION

1. Field of the Invention

The present invention relates to a variable compression ratio internal combustion engine that changes the compression ratio of the internal combustion engine by changing the volume of a combustion chamber. In particular, it relates to a variable compression ratio internal combustion engine having a camshaft with a shaft member and a cam member fixed to the shaft member, and a movable bearing member rotatably fixed to the shaft member, wherein the camshaft is rotated to move a cylinder block and a crankcase toward and away from each other.

2. Description of the Related Art

In recent years, there has been proposed art capable of changing the compression ratio of an internal combustion engine for the purpose of improving fuel economy performance, output performance, and the like. Such art includes art in which a cylinder block and a crankcase are coupled with each other to enable relative movement therebetween, and camshafts are provided on the coupling portions thereof, the camshafts being rotated to cause relative movement between the cylinder block and the crankcase along the cylinder axial direction to change the volume of the combustion chamber and change the compression ratio. Such art is proposed in the Japanese Patent Application Publications Nos. JP-A-2003-206771 and JP-A-2005-113839.

In the foregoing art, however, the length of the movable bearing operating line segment, which is a line segment joining the center of the shaft member of the camshaft and the center of rotation of the movable bearing member in the bearing housing hole, is often equal to that of the cam operating line segment, which is the line segment joining the center of the shaft member of the camshaft and the center of rotation of the cam member in the cam housing hole.

In the above-described known configuration, depending upon the attitude of the movable bearing operating line segment and the cam operating line segment when the compression ratio of the internal combustion engine is changed, there are cases in which a force acting in the direction that moves the cylinder block and the crankshaft away from each other is amplified by combustion pressure in the internal combustion engine or the like in the direction of the movable bearing operating line segment and the cam operating line segment. When this occurs, deformation caused by the combustion pressure of the camshaft itself or the parts of the cylinder block or crankcase mated to the camshaft increases, and there is a risk of increased vibration of the internal combustion engine.

SUMMARY OF THE INVENTION

The present invention has an object to provide art enabling the suppression of vibration in a variable compression ratio internal combustion engine, regardless of the compression ratio.

A first aspect of the present invention is a variable compression ratio internal combustion engine having a crankcase into which a crankshaft is assembled; a cylinder block in which a cylinder is formed and that is mounted on the crankcase; and camshafts disposed in parallel with each other on two sides of the cylinder in the cylinder block so as to be rotatable in mutually opposite directions, wherein the camshafts have a shaft member, a cam member fixed to the shaft member, and a movable bearing member rotatably mounted on the shaft member, the cam member being rotatably housed in a cam housing hole, formed in one of the cylinder block and the crankcase, and the movable bearing member being rotatably housed in a bearing housing hole, formed in the other of the cylinder block and the crankcase, the camshafts are rotated to move the crankcase and the cylinder block relatively toward or away from each other to change the compression ratio of the internal combustion engine. A feature of this aspect is that, as viewed from the axial direction of the camshaft, the length of the line segment joining the center of the shaft member, which is the center of rotation of the shaft member, and the center of the movable bearing member, which is the center of rotation of the movable bearing member within the bearing housing hole is set longer than the length of a cam operating line segment, which is a straight line joining the centers of the shaft member and the cam member, wherein the center of the cam member is the center of rotation of the cam member within the cam housing hole.

The variable compression ratio internal combustion engine of the above-described aspect has a shaft member, a cam member fixed to the shaft member, and a movable bearing member rotatably mounted on the shaft member. By rotating the camshaft, the shaft member and the movable bearing member are caused to rotationally move with respect to the center of the cam member, this rotational movement being used to move the cylinder block and the crankcase toward or away from each other.

In a variable compression ratio internal combustion engine such as this, it to be considered that the operation of changing the compression ratio for the case in which the above-noted movable bearing operating line segment and cam operating line segment are made the same length. In this case, the angle of the movable bearing operating line segment and the cam operating line segment with respect to the cylinder axis line when the camshaft is rotated to change the compression ratio is set, for example, so that at the minimum compression ratio in the compression ratio range the angle is substantially 0°, and that when the camshaft is rotated 90° from this orientation to the maximum compression ratio the angle is substantially 90°.

If this is done, in the case in which a load caused by the combustion pressure in the internal combustion engine acts in a direction to move the cylinder block and the crankcase away from each other, particularly in the vicinity of the maximum compression ratio, because the angle of the movable bearing operating line segment and the cam operating line segment with respect to the operating line of the load caused by the combustion pressure acting on the camshaft is approximately 90°, there are cases in which the load due to the combustion pressure is dynamically amplified in the direction of the movable bearing operating line segment and the cam operating line segment.

If this occurs, vibration can be caused in the camshaft and in parts mated to the camshaft in the cylinder block or crankcase. Particularly with regard to the movable bearing member, because the structure is such that in the vicinity of the maximum compression ratio the rotational play in the bearing housing holes increases, the above-noted vibration tends to occur and it can become difficult to maintain accuracy in control of the compression ratio.

Given the above, in this aspect the length of the movable bearing operating line segment was made longer than the length of the cam operating line segment. By doing this, it is possible to prevent in particular the angle of the movable bearing operating line segment with respect to the line of action of the load due to combustion pressure from falling in the vicinity of 90°, and it is possible in particular to prevent the amplification and acting of the load caused by combustion pressure in the direction of the movable bearing operating line segment.

In the above aspect, a minimum compression ratio in a compression ratio range may be obtained when an orientation of centers of the movable bearing member, the shaft member, and the cam member of the camshaft, as viewed from the axial direction of the camshaft, are aligned in the stated order in a substantially straight line that is substantially parallel to the axial direction of the cylinder, and a maximum compression in the compression ratio range may be obtained when the orientation of the centers of the movable bearing member, the cam member, and the shaft member, as viewed from the axial direction of the camshaft, are aligned in the stated order in a substantially straight line that is substantially parallel to the axial direction of the cylinder, the maximum compression ratio being obtained by rotating the camshaft by substantially 180° from the orientation in which the minimum compression ratio is obtained.

By doing this, in condition of the maximum compression ratio in which the greatest combustion pressure acts, the movable bearing operating line segment and the cam operating line segment can be made parallel to the direction in which the combustion pressure acts. As a result, amplification of the load caused by the combustion pressure in the direction of the movable bearing operating line segment and the cam operating line segment can be suppressed. The same effect can be expected at the minimum compression ratio as well.

The foregoing is the same if the maximum compression ratio is set as the orientation of the above-noted centers are aligned in a substantially straight line and the minimum compression ratio is set as the orientation obtained by rotating 180°. Accordingly, in the aspect of the present invention, therefore, the maximum compression ratio in the compression ratio range may be obtained in the orientation of the centers of the movable bearing member, the shaft member, and the cam member of the camshaft, as viewed from the axial direction of the camshaft, are aligned in the stated order in a substantially straight line that is substantially parallel to the axial direction of the cylinder, and wherein the minimum compression ratio in the compression ratio range may be obtained in the orientation of the centers of the movable bearing member, the cam member, and the shaft member, as viewed from the axial direction of the camshaft, are aligned in the stated order in a substantially straight line that is substantially parallel to the axial direction of the cylinder, the minimum compression ratio being obtained by rotating the camshaft by substantially 180° from the orientation in which the maximum compression ratio is obtained.

In the above aspect, when the camshaft is rotated by substantially 90° from the orientation in which either the minimum compression ratio or the maximum compression ratio in the compression ratio range is obtained, the ratio of the length of the movable bearing member operating line segment to the length of the cam operating line segment may be set so that the compression ratio is a median value of the compression ratio range.

The rotational angle of the camshaft in the median compression ratio of the maximum compression ratio and the minimum compression ratio changes by the ratio of the length of the movable bearing member operating line segment to the length of the cam operating line segment. This ratio, therefore, when the camshaft is rotated by substantially 90° from the orientation in which either the minimum compression ratio or the maximum compression ratio, is set so that the compression ratio is a median value between the maximum compression ratio and the minimum compression ratio. By doing this, it is possible to improve the linearity between the rotational angle of the camshaft and the compression ratio to progress the controllability of the compression ratio.

In the above aspect, the ratio of the length of the movable bearing member operating line segment to the length of the cam operating line segment may be 1.3 or greater.

In the case in which the load caused by the combustion pressure acts on the cam member and the movable bearing member, it is known that, depending upon the ratio of the length of the movable bearing operating line segment to the length of the cam operating line segment, in addition to the linearity between the rotational angle of the camshaft there is a change in the torque required to drive the camshaft and the force acting on the camshaft caused by the combustion pressure.

For the maximum value of force acting on the camshaft caused by the combustion pressure, it is possible to suppress the value lower, as the ratio of the length of the movable bearing operating line segment to the cam operating line increases. From this standpoint, therefore, it is advantageous that the ratio of the length of the movable bearing operating line segment be large with respect to the cam operating line segment.

If the ratio of the length of the movable bearing operating line segment to the cam operating line segment is made around 1.5, the change in the compression ratio with respect to the rotational angle of the camshaft is substantially uniform, and it is known that it is possible to inhibit a sudden change in the compression ratio with respect to a slight change in the rotational angle. In this case, in the orientation in which the camshaft is rotated by substantially further 90° from the orientation of the minimum compression ratio, it is possible to obtain a median value of the compression ratio.

The larger is the ratio of the length of the movable bearing operating line segment to the cam operating line segment, the greater is the suppression of the maximum torque required to drive the camshaft.

The larger is the ratio of the length of the movable bearing operating line segment to the cam operating line segment, the smaller the maximum value of the angle of the line of action of the load caused by the combustion pressure on the movable bearing operating line segment can be made. By doing this, it is possible to suppress the maximum value of the rotational play of the movable bearing member with respect to the bearing housing holes to a low value.

Additionally, the larger is the ratio of the length of the movable bearing operating line segment to the cam operating line segment, the smaller the maximum value of change of the compression ratio with respect to a change in the angle of the camshaft can be made. By doing this, it is possible to improve the linearity between the rotational angle of the camshaft and the compression ratio.

In addition, it is known that, in an orientation in which the ratio of the length of the movable bearing operating line segment to the cam operating line segment is 2 or greater, there is not much change in the above-noted effects by further increasing the ratio.

In the above aspect, the shaft member may have a cylindrical outer shape, the cam member, as viewed from the axial direction of the camshaft, is eccentric with respect to the center of the shaft member and has a circular cam profile having a diameter greater than that of the shaft member, and the cam housing hole has the same circular shape as the cam member, the movable bearing member having a circular outer diameter that is larger than the diameter of the cam member that is eccentric with respect to the center of the shaft member, and the bearing housing hole having the same circular shape as the movable bearing member.

By doing this, compared with a known mechanism, it is possible without changing the configuration of moving parts or the mechanism itself to achieve the effect of the present invention by, for example, making the diameters of the bearing housing holes and the movable bearing member large.

In the above aspect, the frequency of use of a prescribed first angle range, which is in the vicinity of 60° rotation of the camshaft from the orientation in which the centers of the movable bearing member, the shaft member, and the cam member of the camshaft are aligned in the stated order in a substantially straight line that is substantially parallel to the cylinder, and/or a prescribed second angle range, which is in the vicinity of 90° rotation of the camshaft from the orientation in which the centers of the movable bearing member, the shaft member, and the cam member of the camshaft are aligned in the stated order in a substantially straight line that is substantially parallel to the cylinder may be lower than any other possible angle ranges.

In this case, it is known that, regardless of the ratio of the length of the movable bearing operating line segment to the length of the cam operating line segment, in the vicinity of the rotation of the camshaft 90° from the orientation in which the centers of the movable bearing member, the shaft member, and the cam member of the camshaft are aligned in a substantially straight line that is substantially parallel to the axial direction of the cylinder, the load caused by the combustion pressure is amplified and acts in the direction of the cam operating line segment or the movable bearing operating line segment. In the same manner, it is known that, regardless of the ratio of the length of the movable bearing operating line segment to the length of the cam operating line segment, in the vicinity of the rotation of the camshaft 60° from the above-described orientation, the torque required when driving the camshaft is maximum.

Given the above, if the frequency of use of a prescribed first angle range, which is in the vicinity of 60° rotation of the camshaft from the orientation in which the centers of the movable bearing member, the shaft member, and the cam member of the camshaft are aligned in the stated order in a substantially straight line that is substantially parallel to the cylinder, and/or a prescribed second angle range, which is in the vicinity of 90° rotation of the camshaft from the orientation in which the centers of the movable bearing member, the shaft member, and the cam member of the camshaft of the camshaft are aligned in the stated order in a substantially straight line that is substantially parallel to the cylinder is made lower than any other possible angle ranges, it is possible to suppress vibration in camshaft or parts mated to the camshaft in the cylinder block or crankcase. It is also possible to suppress an increase in the camshaft holding torque and driving torque.

The second aspect of the present invention is a variable compression ratio internal combustion engine having a crankcase into which a crankshaft is assembled; a cylinder block in which a cylinder is formed and that is movably mounted on the crankcase; and camshafts disposed in parallel with each other on two sides of the cylinder in the cylinder block so as to be rotatable in mutually opposite directions, wherein the camshafts include a shaft member, a cam member fixed to the shaft member, and a movable bearing member rotatably mounted on the shaft member, the cam member being rotatably housed in a cam housing hole, formed in one of the cylinder block and the crankcase, and the movable bearing member being rotatably housed in a bearing housing hole, formed in the other of the cylinder block and the crankcase, the camshafts are rotated to move the crankcase and the cylinder block relatively toward or away from each other to change the compression ratio of the internal combustion engine. A feature of this aspect is that the internal combustion engine has a first compression ratio that is obtained when the orientation of the centers of the movable bearing member, the shaft member, and the cam member of the camshaft, as viewed from the axial direction of the camshaft, are aligned in the stated order in a substantially straight line that is substantially parallel to the axial direction of the cylinder, and a third compression ratio that is obtained when the orientation of the centers of the movable bearing member and the cam member are, as viewed from the axial direction of the camshaft, aligned in a substantially straight line that is substantially parallel to the axial direction of the cylinder, in the order in which the center of the movable bearing member is disposed after the center of the cam, the third compression ratio being obtained by rotating the camshaft by substantially 180° from the orientation in which the first compression ratio is obtained, and wherein one of the first compression ratio and the third compression ratio is set as the minimum compression ratio of the compression ratio range, and the other of the first compression ratio and the third compression ratio is set as the maximum compression ratio of the compression ratio range.

In this aspect, the variable compression ratio internal combustion engine may be an variable compression ratio internal combustion engine, wherein the shaft member has a cylindrical outer shape and the cam member is, as viewed from the axial direction of the camshaft, eccentric with respect to the center of the shaft member and has a circular cam profile having a diameter greater than that of the shaft member, and wherein the cam housing hole has the same circular shape as the cam member, the movable bearing member having the same circular outer diameter as the cam member that is eccentric with respect to the center of the shaft member, and the bearing housing hole having the same circular shape as the movable bearing member, the variable compression ratio internal combustion engine further including a first controller that controls the compression ratio by rotating the camshaft between a first orientation, in which, as viewed from the axial direction of the camshaft, the centers of the movable bearing member, the shaft member, and the cam member of the camshaft are aligned in the stated order in a substantially straight line that is substantially parallel to the axial direction of the cylinder, and a second orientation, in which, as viewed from the axial direction of the camshaft, the centers of the movable bearing member and the cam member are superposed and the centers of the movable bearing member, the cam member, and the shaft member are aligned substantially perpendicular to the axial direction of the cylinder, the second orientation being obtained by rotating the camshaft 90° from the first orientation, to control the compression ratio between the first compression ratio in the first orientation and the second compression ratio in the second orientation; and a second controller that, from the second orientation, rotates the camshaft further in a rotational direction away from the first orientation, while maintaining the compression ratio at the second compression ratio and maintaining the superposition of the centers of the movable bearing member and the cam member.

In this case, in the variable compression ratio internal combustion engine of the above-noted aspect, a camshaft is provided that has a shaft member, a cam member fixed to the shaft member, and a movable bearing member rotatably mounted on the shaft member. By rotating the camshaft the cam member and the movable bearing member are caused to rotate with respect to the center of the shaft member, this rotational movement being used to move the cylinder block and the crankcase toward or away from each other.

When considering that the compression ratio increases as the orientation of the camshaft changes from the first orientation to the second orientation, the relationship between the camshaft, the cylinder block, and the crankcase is as follows. Specifically, in the first orientation, in which the cylinder block and the crankcase are distanced from each other, the centers of the movable bearing member, the shaft member, and the cam member of the camshaft are aligned in a substantially straight line that is substantially parallel with the axial direction of the cylinder. In contrast, in the second orientation, in which the cylinder block and the crankcase are moved toward one another, the centers of the movable bearing member and the cam member are superposed, and the centers of the movable bearing member, the cam member, and the shaft member are aligned substantially perpendicular to the axial direction of the cylinder.

That is, in above-described variable compression ratio internal combustion engine, when the camshaft is rotated to change the compression ratio, the angle made with respect to the cylinder axis line by the line segment joining the centers of the cam member and the movable bearing member (hereinafter "movable bearing operating line segment") and the line segment joining the centers of the shaft member and the movable bearing member (hereinafter "cam operating line segment) is in the vicinity of 0° in the first orientation of the camshaft and is in the vicinity of 90° in the second orientation of the camshaft.

Given the above, in the case in which load caused by the combustion pressure in the internal combustion engine acts in a direction that moves the cylinder block and the crankcase away from each other, because the angle of the movable bearing operating line segment and the cam operating line segment with respect to the acting line when the load due to combustion pressure acts on the camshaft becomes approximately 90°, there are cases in which the load due to the combustion pressure is dynamically amplified in the direction of the movable bearing operating line segment and the cam operating line segment.

If this occurs, vibration can be caused in the camshaft and in parts mated to the camshaft in the cylinder block or crankcase. Particularly with regard to the movable bearing member, because the structure is such that in the vicinity of the maximum compression ratio the rotational play in the bearing housing holes increases, the above-noted vibration tends to occur and it can become difficult to maintain accuracy in control of the compression ratio.

The above-noted aspect may have, in addition to a first controller, which rotates the camshaft between the first orientation and the second orientation to control the compression ratio, a second controller, which rotates the camshaft further, while maintaining the compression ratio in the second orientation, that is, while maintaining the relative positions between the cylinder block and the crankcase.

By doing this, in the case in which the compression ratio of the above-noted variable compression ratio internal combustion engine is made the second compression ratio, after the first controller sets the camshaft to the second orientation, it is possible for the second controller to further rotate the camshaft to move the angle of the movable bearing operating line segment and the cam operating line segment with the axial line of the cylinder away from 90°. As a result, it is possible to suppress the amplification and acting of the load caused by the combustion pressure in the direction of the movable bearing operating line segment and the cam operating line segment, and possible suppress vibration in the variable compression ratio internal combustion engine.

In the above-described variable compression ratio internal combustion engine, the second controller may have a prohibiting device that, when rotating the camshaft from the second orientation in the direction away from the first orientation, prohibits further movement of the cylinder block and the crankcase either together or apart.

By doing this, if the second controller rotates the camshaft from the second orientation in the direction opposite from the rotational direction that obtains the first orientation, there is no further relative movement between the cylinder block and the crankcase.

According to the simple constitution of the second aspect, it is possible to rotate the camshaft further from the second orientation, while maintaining the compression ratio at the second compression ratio, and while maintaining the superposition of the centers of the movable bearing member and the cam member of the camshaft.

The prohibiting device as used herein may be a stopper structure that the cylinder block and the crankcase to come into contact in the second orientation to prohibit further movement together.

In the above-noted aspect, the first compression ratio may be the minimum compression ratio in the compression ratio range of the internal combustion engine, and the second compression ratio may be the maximum compression ratio in the compression ratio range of the internal combustion engine. By doing this, in the condition of the maximum compression ratio, in which the largest combustion pressure acts, it is possible to prevent the angle of the movable bearing operating line segment and the cam operating line segment with the cylinder axis line from remaining in the vicinity of 90°, and possible to more effectively suppress vibration in the variable compression ratio internal combustion engine.

The first compression ratio may be the maximum compression ratio in the compression ratio range of the internal combustion engine, and the second compression ratio may be the minimum compression ratio in the compression ratio range of the internal combustion engine. In this case, there are cases in which the cylinder block and crankcase are set to be closest together in the first orientation and set to be farthest away from each other in the second orientation. By applying this aspect of the present invention in this case as well, in the orientation of the minimum compression ratio, it is possible to prevent the angle of the movable bearing operating line segment and the cam operating line segment with the cylinder axis line from remaining in the vicinity of 90°, and possible to suppress vibration in the variable compression ratio internal combustion engine.

In the above-noted aspect, when the compression ratio is changed to the second compression ratio as a target compression ratio, the first controller may set the camshaft to the second orientation to obtain the second compression ratio, and the second controller may rotate the camshaft by substantially 90° beyond the second orientation in the direction away from the first orientation.

In this case, in the case in which the target compression ratio in the variable compression ratio internal combustion engine is the second compression ratio, that is, the compression ratio of the second orientation, in which the movable bearing member operating line and the cam operating line segment make an angle of 90° with the axial direction of the cylinder, rather than rotating the camshaft to the second orientation, the camshaft is rotated by 90° further in the direction that is away from the first orientation.

As a result, it is possible to obtain the orientation in which the movable bearing operating line segment and the cam operating line segment are substantially parallel to the axial direction of the cylinder, while maintaining the compression ratio at the second compression ratio. If this is done, it is possible to suppress the amplification and acting of the load caused by the combustion pressure in the direction of the movable bearing operating line segment and the cam operating line segment. As a result, it is possible to suppress vibration in the variable compression ratio internal combustion engine.

In the above-noted aspect, when the variable compression ratio internal combustion engine is idling and the compression ratio is the second compression ratio, the second controller may rotate the camshaft by substantially 90° beyond the second orientation in the direction away from the first orientation.

Compression ratio changing control in a variable compression ratio internal combustion engine must exhibit at least some degree of rate at which the compression ratio is changed. In particular, when in a condition of a relatively high compression ratio, it is necessary to quickly reduce the compression ratio if a condition occurs in which there is a tendency to knocking.

In contrast, when the variable compression ratio internal combustion engine is idling, the vehicle in which the variable compression ratio internal combustion engine is mounted is often stopped. In this condition, there is little possibility of a sudden change in the operating condition of the variable compression ratio internal combustion engine, and it can be said that the possibility of a sudden change in the target compression ratio is small. In this type of case, therefore, even if the second controller rotates the camshaft by substantially 90° beyond the second orientation in the direction away from the first orientation, there is a small possibility that this will affect subsequent quick control of the compression ratio. More effective suppression of vibration is therefore possible, without affecting the controllability of the compression ratio.

In the above-noted aspect, in the variable compression ratio internal combustion engine, when an operating condition of the variable compression ratio internal combustion engine falls in a prescribed second compression ratio region, the second compression ratio may be set as a target compression ratio, when the operating condition falls in another compression ratio region, the compression ratio may be changed from the second compression ratio, and when the second compression ratio is set as the target compression ratio, the first controller may set the camshaft to the second orientation to obtain the second compression ratio, the second controller may rotate the camshaft beyond the second orientation in the direction away from the first orientation to obtain a third orientation, and the second controller may cause the angle of the camshaft in the third orientation to approach the angle in the second orientation, as the operating condition approaches the border between the second compression ratio region and the other compression ratio region.

In the variable compression ratio internal combustion engine, in a condition falling in a prescribed operation condition region, control is performed to fix the compression ratio to a compression ratio in accordance with that operating condition. For example, in the case in which the operating condition falls in the second compression ratio region, the compression ratio is fixed to the second compression ratio.

In the above-noted aspect, when fixing the compression ratio to the second compression ratio, the second controller rotates the camshaft beyond the second orientation to the third orientation in a direction away from the first orientation. By doing this, amplification and acting of a load caused by the combustion pressure in the direction of the movable bearing operating line segment and the cam operating line segment is suppressed.

In this case, however, if it is desired, for example, to change the compression ratio from the second compression ratio to the first compression ratio, it is necessary to first rotate the camshaft by the second controller from the third orientation to the second orientation, and then to further rotate the camshaft by the first controller from the second orientation to the first orientation. When this is done, there are cases in which quick changing of the compression ratio is difficult. Also, when doing this, it becomes more difficult to quickly change the compression ratio if the angle of the camshaft in the second orientation is greatly offset from the angle of the camshaft in the third orientation.

In the above-noted aspect, the second controller causes the angle of the camshaft in the third orientation to approach the angle in the second orientation, as the operating condition approaches the border between the second compression ratio region and the other compression ratio region.

By doing this, the greater the possibility that the operating condition of the variable compression ratio internal combustion engine will transition from the second compression ratio region to another compression ratio region, the closer the angle of the camshaft in the third orientation is brought to the angle in the second orientation. As a result, it is possible to perform faster compression ratio control in the case in which the operating condition changes, making it necessary to change the compression ratio from the second compression ratio.

In the above-noted aspect, in the variable compression ratio internal combustion engine, when an operating condition of the variable compression ratio internal combustion engine falls in a prescribed second compression ratio region, the second compression ratio may be set as a target compression ratio, when the operating condition falls in another compression ratio region, the compression ratio may be changed from the second compression ratio, and when the second compression ratio is set as the target compression ratio, the first controller may set the camshaft to the second orientation to obtain the second compression ratio, the second controller may rotate the camshaft beyond the second orientation in the direction away from the first orientation to obtain a third orientation, and the second controller may cause the angle of the camshaft in the third orientation to approach the angle in the second orientation, as the rate at which the operating condition changes increases when the operating condition falls within the second compression ratio region.

As described above, in the variable compression ratio internal combustion engine of the above-noted aspect, when the operating condition falls in the second compression ratio region, the compression ratio is fixed at the second compression ratio. The camshaft is then further rotated by the second controller from the second orientation to the third orientation. In this case, if a change is to be made of the compression ratio, for example, from the second compression ratio to the first compression ratio, as described above, there are cases in which it is difficult to perform a quick change of the compression ratio.

In contrast, in the case in which the operating condition falls in the second compression ratio region, it can be envisioned that, as the rate at which the operating condition changes increases, the operating condition is likely to shortly transition from the second compression ratio region to another region.

Given the above, in the above-noted aspect, in the case in which the operating condition falls in the second compression ratio region, the second controller causes the angle of the camshaft in the third orientation to approach the angle in the second orientation, as the rate at which the operating condition changes increases.

By doing this, it is possible to bring the angle of the camshaft in the third orientation closer to the angle in the second orientation, when the operating condition of the variable compression ratio internal combustion engine is likely to transition from the second compression ratio to another compression ratio region. As a result, it is possible to perform faster control of the compression ratio when the operating condition changes and the need arises to change the compression ratio from the second compression ratio.

In the above-described aspect, the rate at which the operating condition changes can be obtained based on the engine load on the variable compression ratio internal combustion engine and/or the engine rpm of the variable compression ratio internal combustion engine.

It this aspect, it is possible to use combinations as far as is possible.

In the above-described aspects of the present invention, it is possible to suppress vibration of the variable compression ratio internal combustion engine regardless of the compression ratio.

BRIEF DESCRIPTION OF THE DRAWINGS

The foregoing and further objects, features, and advantages of the invention will become apparent from the following description of preferred embodiments with reference to the accompanying drawings, wherein like numerals are used to represent like elements, and wherein.

DETAILED DESCRIPTION OF THE EMBODIMENTS

Example embodiments of the present invention are described in detail below, with references made to the accompanying drawings.

The internal combustion engine 1 described below is a variable compression ratio internal combustion engine that changes the compression ratio by causing movement of a cylinder block 3, that has cylinders 2 with respect to the crankcase 4 to which the pistons are linked, in the center axial direction of the cylinders 2.

Figure 1:
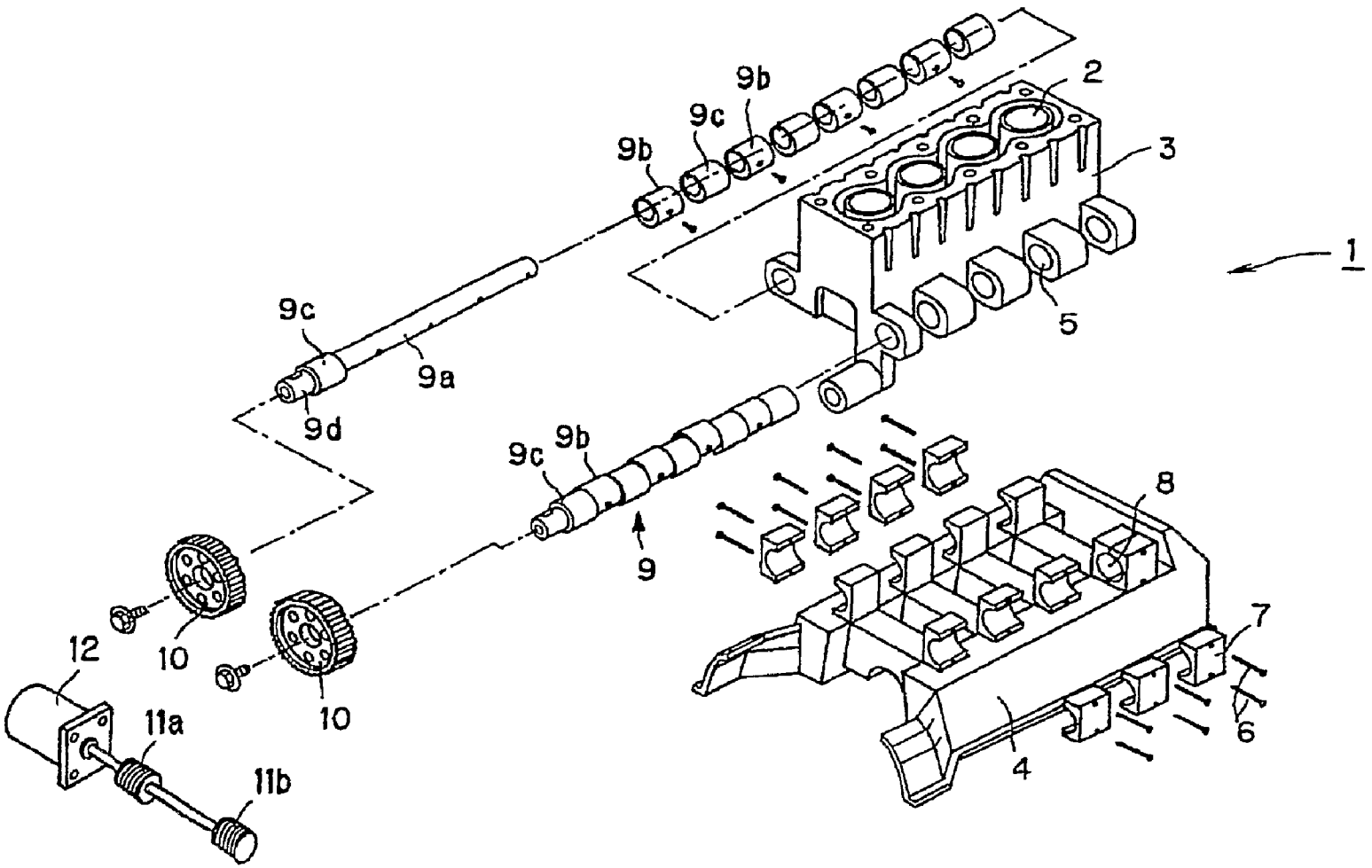
FIG. 1 is an exploded perspective view showing the general configuration of a variable compression ratio internal combustion engine according to a first embodiment of the present invention.

First, referring to FIG. 1, the constitution of this embodiment for changing the compression ratio will be described. As shown in FIG. 1, a plurality of protruding parts are formed on two sides of the lower part of the cylinder block 3, and bearing housing holes 5 are formed in each of these protruding parts. The bearing housing holes 5, circular in shape, extend perpendicularly to the axial direction of the cylinders 2 and are arranged in a direction parallel to the direction in which the plurality of cylinders 2 are arranged. The bearing housing holes 5 on one side of the cylinder block 3 are all disposed along one and the same axis line, and the axis lines of the bearing housing holes 5 on each side of the cylinder block 3 form a pair of parallel axis lines.

The crankcase 4 has a vertical wall parts formed between the plurality of protruding parts in which the above-described bearing housing holes 5 are formed. A semicircular depression is formed in the surface of each vertical wall part on the outside of the crankcase 4. Each vertical wall part also has a cap 7 mounted by a bolt 6, and the caps 7 also have semicircular depressions. When the caps 7 are mounted on each vertical wall part, circular cam housing holes 8 are formed.

The plurality of cam housing holes 8, in the same manner as the bearing housing holes 5, extend perpendicularly to the axis direction of the cylinders 2 when the cylinder block 3 is mounted on the crankcase 4, and also are each formed to be parallel to the direction in which the plurality of cylinders 2 are arranged. These cam housing holes 8 are also formed on two sides of the cylinder block 3, and all of the cam housing holes 8 formed on one side of the cylinder block 3 are all disposed along one and the same axis line. The axis lines of cam housing holes 8 on two sides of the cylinder block 3 are parallel to one another. The distance between the centers of the bearing housing holes 5 on two sides and the distance between the centers of the cam housing holes 8 on two sides are the same.

A camshaft 9 is passed through each of the opposing two rows of bearing housing holes 5 and cam housing holes 8. As shown in FIG. 1, each of the camshafts 9 has a shaft member 9*a*, cam members 9*b* having circular cam profiles and fixed to the shaft member 9*a* eccentrically with respect to the center of the shaft member 9*a*, and movable bearing members 9*c* rotatably fixed to the shaft member 9*a* and also having a circular outer shape. The cam members 9*b* and the movable bearing members 9*c* are alternately disposed. The pair of camshafts 9 are in a mirror-image relationship. A mounting part 9*d* for mounting a gear 10, described below, is formed on the end parts of the camshafts 9. The center axis of the shaft member 9*a* and the center axis of the mounting part 9*d* are mutually eccentric, the center of the cam member 9*b* and the center of the mounting part 9*d* are coaxial.

The moving bearing member 9*c* is also eccentric with respect to the shaft member 9*a*. In each of the camshafts 9 the direction of eccentricity of the plurality of the cam members 9*b* is the same.

A gear 10 is mounted on one end of each of the camshafts 9. Each of the pair of gears 10 fixed to the end parts of the pair of camshafts 9 engages with worm gears 11*a*, 11*b*. The worm gears 11*a*, 11*b* are fixed to one output shaft of a single motor 12. The worm gears 11*a*, 11*b* have helical grooves that rotate in mutually opposite directions. For this reason, when the motor 12 rotates, the pair of camshafts 9 rotate, via the gears 10, in mutually opposite directions. The motor 12 is mounted on the crankcase 4.

In a known variable compression ratio internal combustion engine, the length of the line segment L1 joining the centers of the bearing members 9*a* and the cam members 9*b* of the camshaft 9 is set to be equal to the length of the line segment L2 joining the centers of the bearing members 9*a* and the movable bearing members 9*c*. The change from the minimum compression ratio to the maximum compression ratio is performed as shown in FIG. 2A through FIG. 2C and FIG. 4A.

Figures 2A, 2B, 2C:
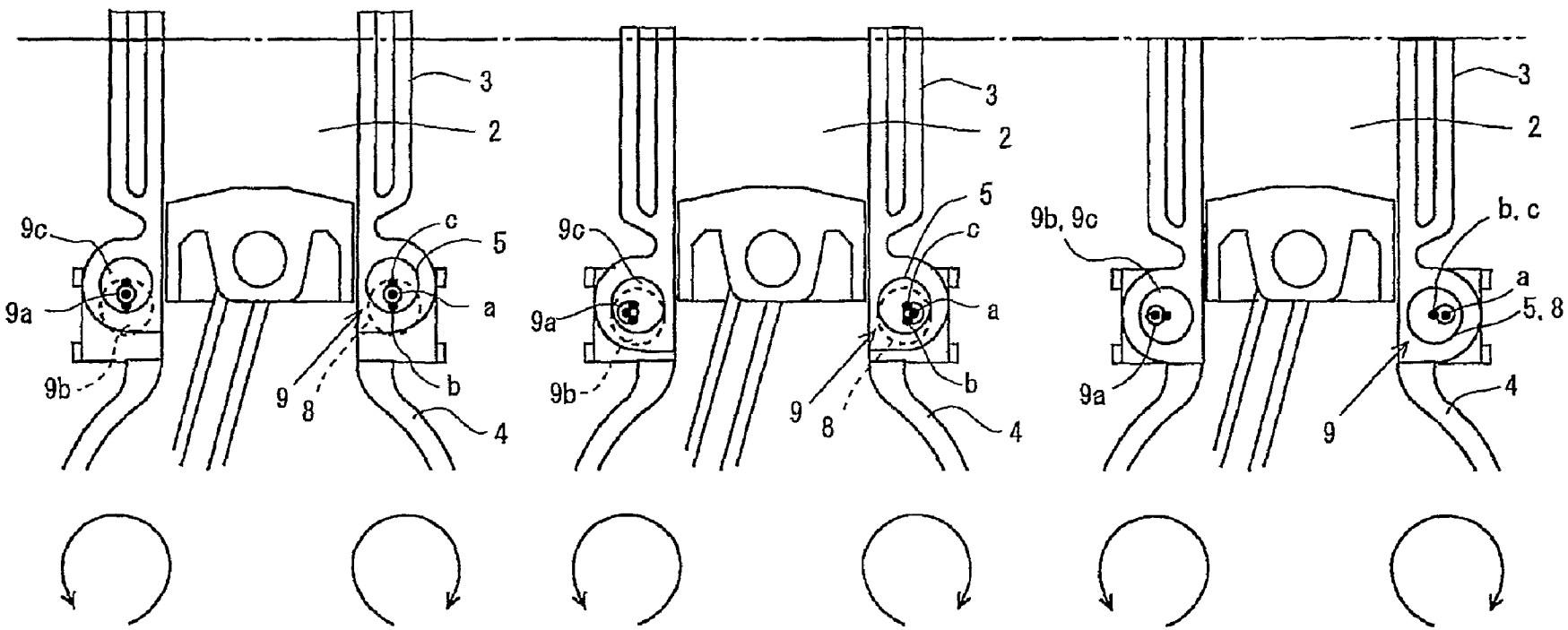
FIG. 2A through FIG. 2C are cross-sectional views showing the progress of relative movement of the cylinder block with respect to the crankcase in a known variable compression ratio internal combustion engine.
Figure 4A:
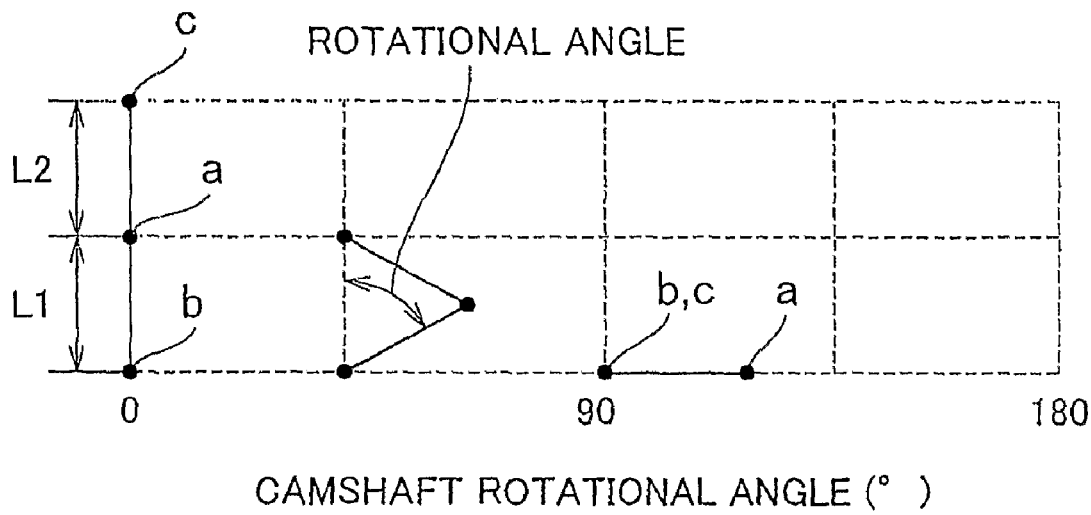
FIG. 4A is a drawing showing the movement of the line segment joining the centers of the shaft member and the cam member and the line segment joining the centers of the shaft member and the movable bearing member, in response to a change in the rotational angle of the camshaft in a known variable compression ratio internal combustion engine.

FIG. 2A through FIG. 2C are cross-sectional views showing the operational relationship between the cylinder block 3, the crankcase 4, and the camshafts 9 assembled therebetween. FIG. 4A shows the movements of the line segments L1 and L2 in response to changes in the rotational angle of the camshaft 9. In FIG. 2A through FIG. 2C and FIG. 4A and FIG. 4B, a is the center of the shaft member 9*a*, *b* is the center of the cam member 9*b*, and c is the center of the movable bearing member 9*c*. FIG. 2A shows the orientation of the minimum compression ratio within the compression ratio range. In this orientation, the center c of the movable bearing member 9*c*, the center a of the shaft member 9*a*, the center b of the cam member 9*b*, are aligned in the stated order from above in a straight line as shown in FIG. 2A. In this orientation, as shown in FIG. 4A when the rotational angle of the camshaft is 0 degree, the line segments L1 and L2 are disposed on either side of the center a of the shaft member 9*a* in parallel with the axial direction of the cylinder 2.

From the orientation shown in FIG. 2A, if the motor 12 is driven to rotate the shaft members 9*a* in the direction of the arrow, the orientation shown in FIG. 2B occurs. When this occurs, because the line segments L1 and L2 are inclined with respect to the axial direction of the cylinder 2, the angle between the line segments L1 and L2 is reduced, thereby bringing the cylinder block 3 closer to the crankcase 4.

If the motor 12 is driven further to rotate the shaft member 9*a* in the direction of the arrow, the orientation shown in FIG. 2C occurs. This orientation indicates the maximum compression ratio in the compression ratio range. In this orientation, as shown in FIG. 4A, when the camshaft rotational angle is 90°, the line segments L1 and L2 overlap in the direction perpendicular to the axial direction of the cylinder 2. In this orientation, the pair of bearing members 9*a* are positioned toward the outside within the bearing housing hole 5 and the cam housing hole 8.

In this manner, in a known variable compression ratio mechanism, in the orientation of the minimum compression ratio within the compression ratio range, the line segments L1 and L2 are both parallel to the axial direction of the cylinder 2, and the center c of the movable bearing member 9*c*, the center a of shaft member 9*a*, and the center b of the cam member 9*b* are aligned in the stated order in a straight line from the upper side of FIG. 2A and FIG. 2B. By rotation of the camshaft 9, the line segments L1 and L2 rotate in mutually opposite directions, and in the orientation in which the camshaft 9 has rotated by 90° from the minimum compression ratio orientation, both the line segments L1 and L2 are inclined 90° with respect to the axial direction of the cylinder 2, this orientation being the maximum compression ratio orientation.

Consider the orientation of maximum compression ratio in a known variable compression ratio mechanism as described above. In this condition, the line segment L1 joining the center a of the shaft member 9*a* of the camshaft 9 and the center b of the cam member 9*b* of the camshaft 9 and the line segment L2 joining the center a of the shaft member 9*a* of the camshaft 9 and the center c of the movable bearing member 9*c* of the camshaft 9 make an angle of 90° with the respect to the axial direction of the cylinder 2. The load in the direction that moves the cylinder block 3 and the crankcase 4 away from one another due to the combustion pressure of the internal combustion engine 1 acts in a direction parallel to the axial direction of the cylinder 2.

As a result, the load caused by the combustion pressure of the internal combustion engine 1 is greatly amplified in the direction of line segments L1 and L2. In the maximum compression ratio orientation, therefore, a large, periodically occurring load acts on the camshaft 9 and the parts mated with the camshaft 9 in the cylinder block 3 and the crankcase 4. As a result, vibration can increase in the internal combustion engine 1 in the region of the crankshaft 9. In particular, because the movable bearing member 9*c* can rotate relative to the shaft member 9*a* and also is in an orientation in which it can rotate relative to the cylinder block 3, vibration more easily occurs.

In this condition, because of the clearance perpendicular to the cylinder 2 axis of the cylinder block 3 and the crankcase 4 the rotational direction play of the movable bearing member 9*c* increases, causing worsening of the compression ratio tracking with respect to the rotation of the crankshaft 9 to worsen the controllability of the compression ratio.

Additionally, compared with the orientation in which the angle of line segments L1 and L2 with respect to the axial direction of the cylinder 2 is smaller than 90°, for a given load the torque acting on the camshaft 9 to move the cylinder block 3 and the crankcase 4 toward or away from each another is larger. That is, the torque required to maintaining the compression ratio in this orientation tended to increase. In the same manner the torque required to change the compression ratio from this orientation tended to increase. This is one of the reasons that in a known variable compression ratio internal combustion engine the rotational angle of the camshaft 9 could only be used in the range from 0° to 90°. Stated differently, if the lengths of the line segments L1 and L2 are made the same, because there are cases in which the extremely large torque at a camshaft 9 rotational angle of 90°, because smooth operation of the camshaft 9 can be difficult, there were cases in which it was difficult to use a rotational angle of the camshaft 9 in the range from 0° to 180°.

In contrast to the foregoing, in this embodiment the length of the line segment joining the centers of the shaft member and the movable bearing member is made longer than the line segment joining the centers of the shaft member and the cam member. Also, by varying the rotational angle of the camshaft over the range to change the compression ratio, even in the maximum compression ratio orientation, similar to the minimum compression ratio orientation, the line segment joining the centers of the shaft member and the movable bearing member and the line segment joining the centers of the shaft member and the cam member are made to be aligned in a straight line in parallel with the axial direction of the cylinder 2.

Figures 3A, 3B, 3C:
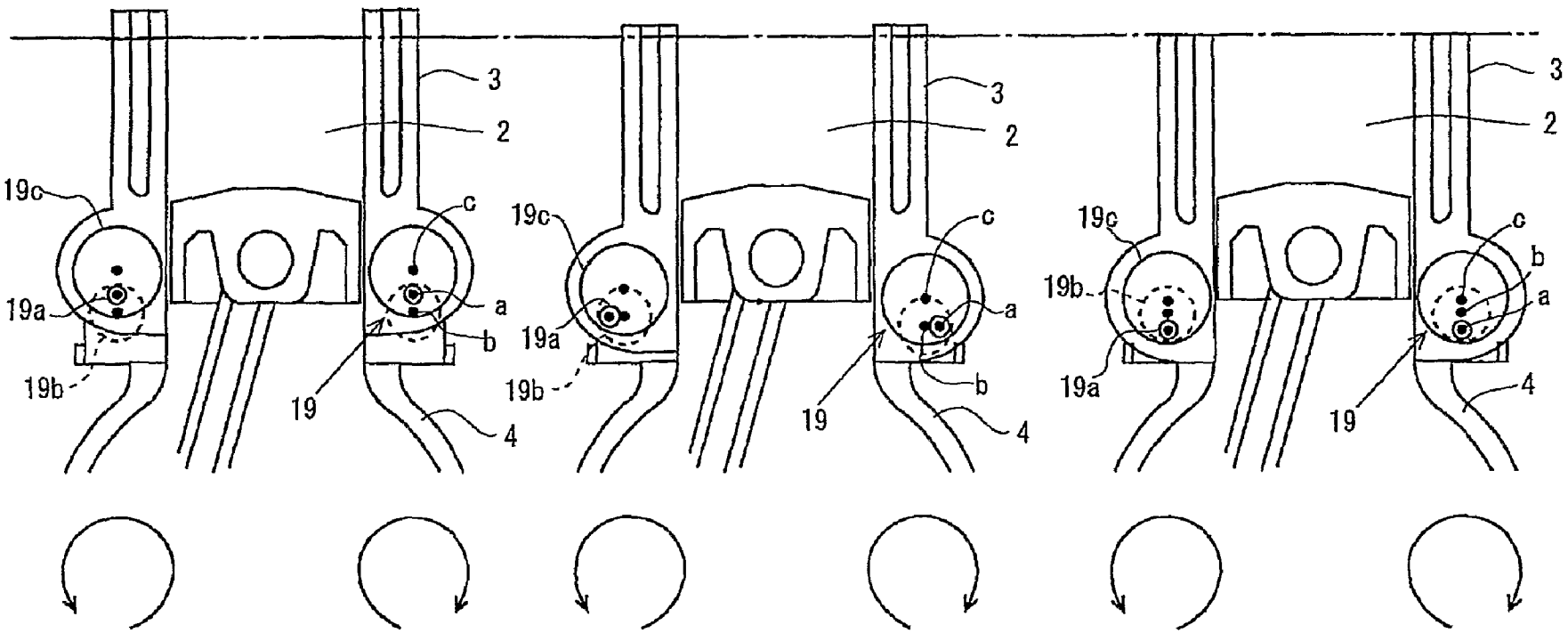
FIG. 3A through FIG. 3C are cross-sectional views showing the progress of relative movement of the cylinder block with respect to the crankcase in a variable compression ratio internal combustion engine according to the first embodiment of the present invention.
Figure 4B:
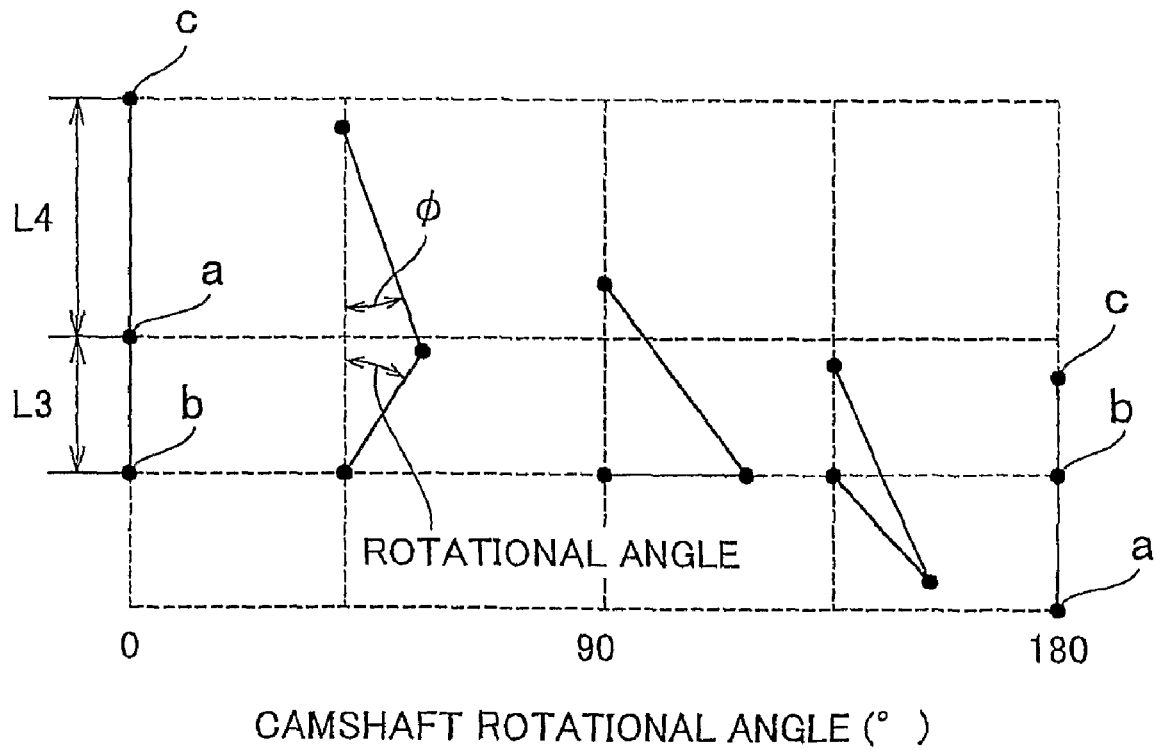
FIG. 4B is a drawing showing the movement of the line segment joining the centers of the shaft member and the cam member and the line segment joining the centers of the shaft member and the movable bearing member, in response to a change in the rotational angle of the camshaft in a variable compression ratio internal combustion engine according to the first embodiment of the present invention.

The action of the camshaft when the compression ratio is changed in this embodiment will now be described using FIG. 3A to 3C and FIG. 4B. In the camshaft 19 in this embodiment, the length of the line segment L4 joining the center a of the shaft member 19*a* and the center c of the movable bearing member 19*c* is made 1.7 times the length of the line segment L3 joining the center a of the shaft member 19*a* and the center b of the cam member 19*b*. At the minimum compression ratio of the compression ratio range, the centers of the various members of the camshaft 19 are aligned in the order of the center c of the movable bearing member 19*c*, the center a of the shaft member 19*a*, and the center b of the cam member 19*b*, from above in a straight line as shown in FIG. 3A to FIG. 3C and FIG. 4A, parallel to the axial direction of the cylinder 2. In the maximum compression ratio orientation in the compression ratio range, which is an orientation in which each of the two camshafts 19 is rotated 180° in mutually opposing directions, the centers of each member of the camshaft 19 are aligned in the order of the center c of the movable bearing member 19*c*, the center b of the cam member 19*b*, and the center a of the shaft member 19*a*, from above in a straight line as shown in FIGS. 3C and 4B, parallel to the axial direction of the cylinder 2.

By changing the compression ratio by the above-noted action, even at the maximum compression ratio of the range, the directions of the line segments L3 and L4 of the camshaft 19 and the direction in which the load caused by the combustion pressure of the internal combustion engine are parallel. As a result, amplification of the load caused by the combustion pressure in the L3 and L4 directions is greatly suppressed. As a result, vibration in the region of the movable bearing member 19*c* of the camshaft 19 is particularly suppressed.

Figure 5:
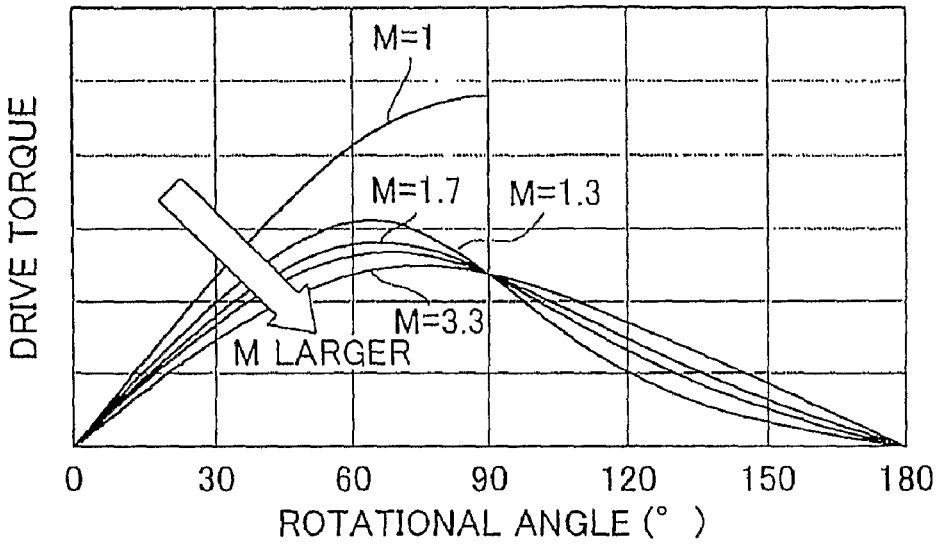
FIG. 5 is a graph showing the change in the relationship between the camshaft rotational angle and the torque acting on the camshaft for various length ratios in the first embodiment of the present invention.

Next, FIG. 5 shows the relationship between the camshaft rotational angle and the torque acting on the camshaft when a load caused by combustion pressure acts in a direction to move the cylinder block 3 and the crankcase 4 away from each other, for the case of various values of M, the ratio of the length of the line segment L4 to the length of the line segment L3. As shown in FIG. 5, when the length ratio M is 1, the torque at a camshaft rotational angle of 90° is maximum. When the length ratio M is 1, the absolute value of the torque becomes prominently greater than the case in which the length ratio M is greater than 1. As the length ratio M increases from 1, maximum value of torque when the camshaft rotational angle is changed decreases. Also, with the length ratio M at 1.3 or greater, it is possible to sufficiently reduce the maximum torque.

Figure 6:
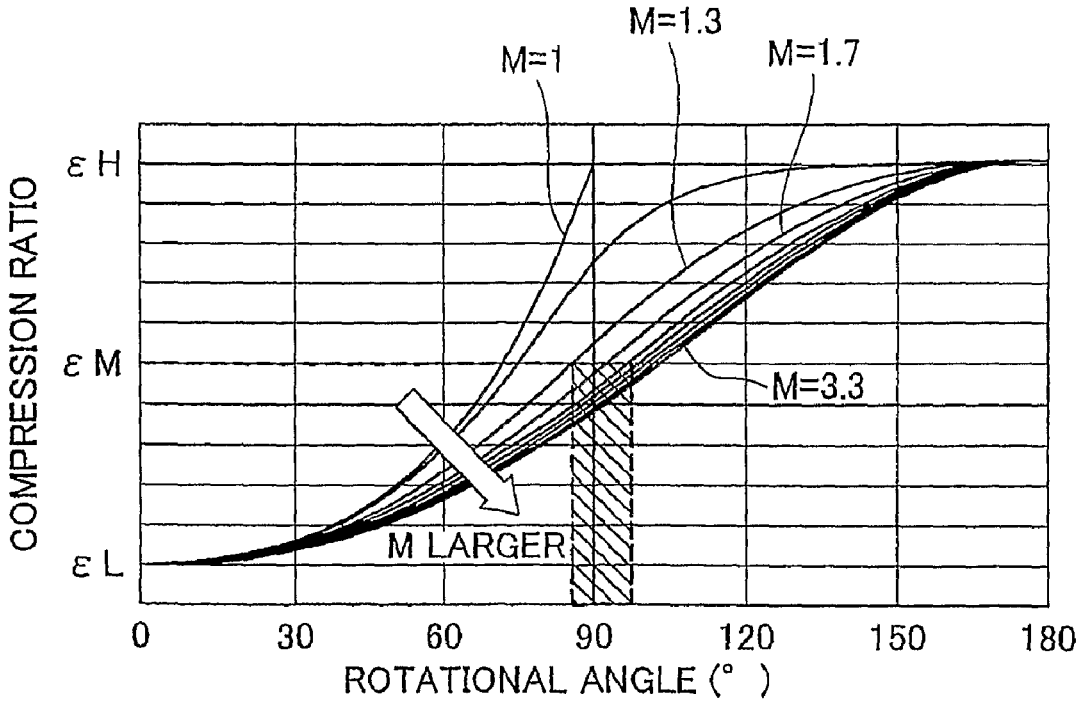
FIG. 6 is a graph showing the change in the relationship between the camshaft rotational angle and the compression ratio for various length ratios in the first embodiment of the present invention.

Next, FIG. 6 shows the change in the relationship between the rotational angle of the camshaft and the compression ratio for various values of the length ratios M. According to FIG. 6, in the case in which the length ratio M is 1 as in the known art, the amount of change of the compression ratio with respect to a change in the rotational angle of the camshaft increases sharply in the vicinity of a rotational angle of 90°. In contrast, when the length ratio increases from 1, as the length ratio increases the variation of the compression ratio with respect to a change in the rotational angle of the camshaft is smoothed. When the length ratio M is 1.3 or greater, it is possible to achieve sufficient smoothing, and therefore an improvement in linearity.

As can be seen from FIG. 6, when M is 1.3 or greater, and particularly when M is in the range from approximately 1.3 to approximately 1.7, it is possible to have the median value of the compression ratio range fall in the vicinity of the rotational angle of the camshaft of 90°. From this, it is possible to improve the symmetry of the relationship between the rotational angle of the camshaft and the compression ratio in this embodiment, which also improves the linearity between the rotational angle of the camshaft and the compression ratio.

Figure 7:
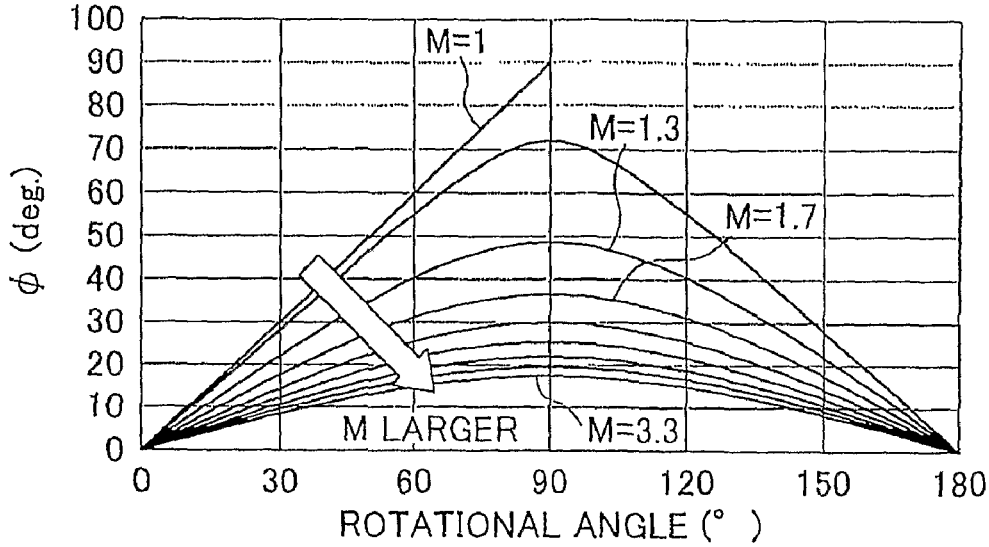
FIG. 7 is a graph showing the change in the relationship between the rotational angle of the camshaft and the angle of the line segment joining the centers of the shaft member and the movable bearing member with respect to the cylinder axial direction for various length ratios in the first embodiment of the present invention.

Next, FIG. 7 shows the change in the relationship between the rotational angle of the camshaft and the angle $\phi$ (shown in FIG. 4B) of the line segment LA with respect to the axial direction of the cylinder 2 for various values of the length ratio M. According to FIG. 7, in the case in which the length ratio M is 1 as in the known art, as the rotational angle of the camshaft increases from 0°, $\phi$ increases linearly, and $\phi$ reaches a maximum value of 90° when the rotational angle of the camshaft is at the 90° point. In contrast, when the length ratio M is made larger than 1, as the length ratio M is made larger, the maximum value of $\phi$ decreases. When the length ratio M is 1.7, the maximum value of $\phi$ is approximately 40° or less.

Because the degree of amplification of the load in the line segment IA direction due to the combustion pressure increases the larger is the value of $\phi$, when M is made 1.7 it is possible to greatly reduce the degree of amplification of the load in the line segment L4 direction due to the combustion pressure.

Figure 8:
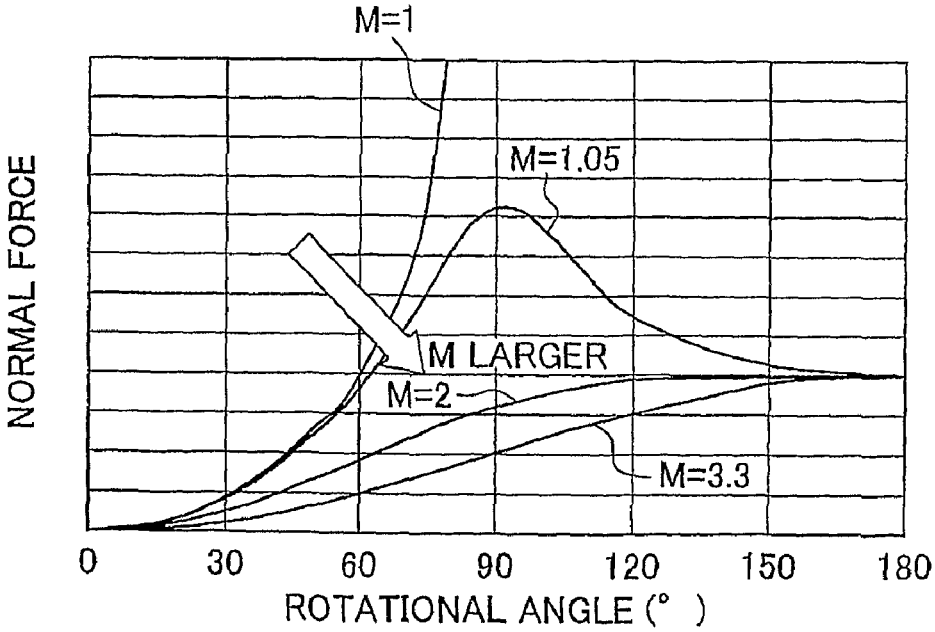
FIG. 8 is a graph showing the change in the relationship between the rotational angle of the camshaft and the normal force acting in the direction of the line segment joining the centers of the bearing member and the cam member for various length ratios in the first embodiment of the present invention.

FIG. 8 shows the change in the relationship between the rotational angle of the camshaft and the normal force acting in the line segment L3 direction, for various values of the length ratio M. According to FIG. 8, when the length ratio M is 1 as in the known art, as the rotational angle of the camshaft approaches 90°, the normal force increases suddenly. In contrast, when the length ratio is made larger than 1, as the length ratio M increases it can be seen that the maximum value of the normal force decreases.

As described above, in this embodiment the length of the line segment joining the centers of the shaft member and the movable bearing member is made 1.7 times the length of the line segment joining the centers of the shaft member and the cam member. By doing this, it is possible to reduce the load acting on the cam member and the movable bearing member of the camshaft due to the combustion pressure. As a result, it is possible to achieve a relative reduction in the rigidity of the camshaft or of the parts in the cylinder block or crankcase mated to the camshaft, thereby enabling suppression of vibration in the vicinity of those parts caused by the combustion pressure. It is also possible to reduce the torque acting on the camshaft caused by the combustion pressure. As a result, it is also possible to reduce the energy required to drive or hold the camshaft using the motor. It is also possible to improve the linearity of the combustion pressure with respect to the change in the rotational angle of the camshaft. In this case, the line segments L1 and L3 correspond to the cam operating line segment, and the line segments L2 and L4 correspond to the movable bearing member operating line segment.

In the foregoing embodiment, the ratio of the length of the line segment joining the centers of the shaft member and the movable bearing member to the length of the line segment joining the centers of the shaft member and the cam member is set to 1.7. This length ratio, however, is not restricted to 1.7. For example, it is possible to sufficiently achieve the effect of the present invention if the length ratio is 1.3 or greater.

As can be seen in FIG. 5, even if the length ratio M is made 1.7, in the case in which the camshaft rotational angle is in the vicinity of 60°, the torque acting on the camshaft caused by the combustion pressure is relatively large. Also, as can be seen from FIG. 7, even if the length ratio M is made 1.7, if the rotational angle of the camshaft is in the vicinity of 90°, $\phi$ becomes the maximum value.

In this embodiment, therefore, the length ratio M may be set to 1.7 and control may be performed to avoid using a rotational angle of the camshaft prescribed ranges in the vicinities of 60° and 90°. For example, if it is determined that the compression ratio demanded by the operating condition of the internal combustion engine 1 is obtained at a rotational angle of the camshaft in the range from 50° to 100°, the compression ratio may be changed by making the rotational angle of the camshaft 45°. Also, if the cooling water or intake air temperature is low and it is less likely for knocking to occur, in the case in which the target rotational angle of the camshaft obtained from the demanded combustion pressure is made 90°, control may be performed to set the rotational angle of the camshaft to 105°, which is on the high compression ratio side. In this case, for example, the range from 50° to 75° of the rotational angle of the camshaft corresponding to a first angle range, and the range from 75° to 100° corresponds to a second angle range.

Alternatively, control may be performed so that the camshaft rotational angle ranges from 50° to 70° and from 80° to 100° are not used. Additionally, in the case of using a camshaft rotational angle in the range from 50° to 70° and in the range from 80° to 100°, control may be performed so that the frequency of using a camshaft rotational angle in the range from 50° to 70° and in the range from 80° to 100° is reduced by, for example, rotating the camshaft to a rotational angle that is close to but outside these angle ranges after a prescribed amount of time has elapsed. In this case, the range from 50° to 70° corresponds to the first angle range and the range from 80° to 100° corresponds to the second angle range.

Figure 9A:
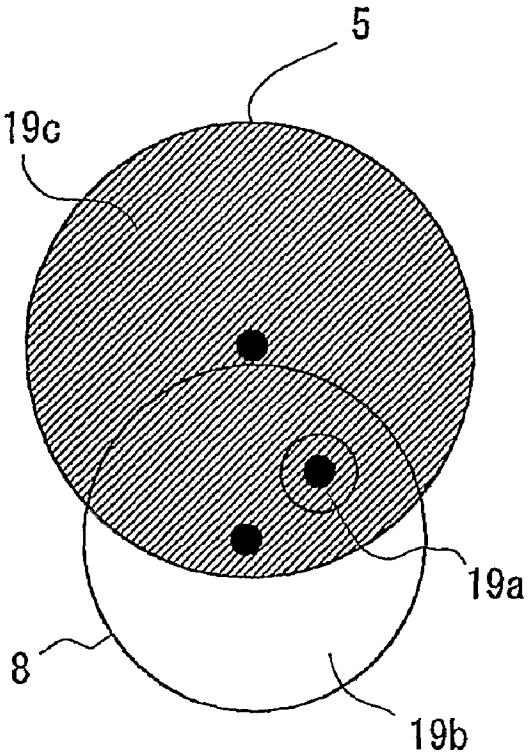
FIG. 9A through FIG. 9C are drawings showing examples of the outer shape of the cam member and the moving bearing member in the first embodiment of the present invention.
Figure 9B:
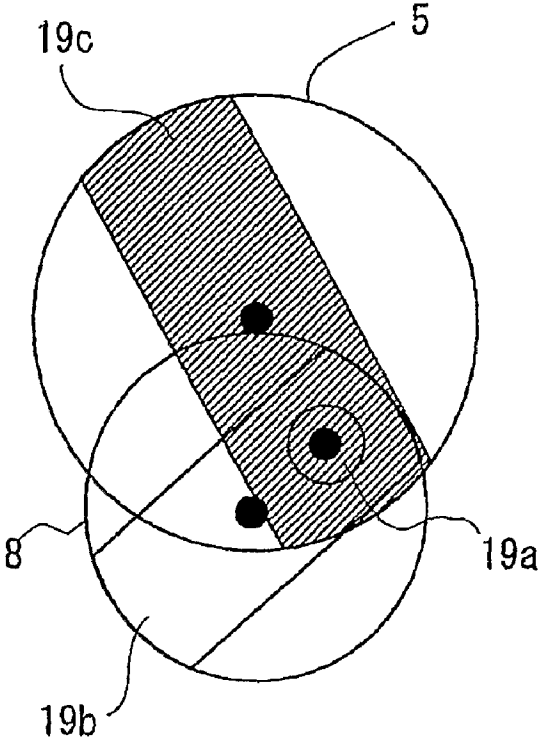
Figure 9C:
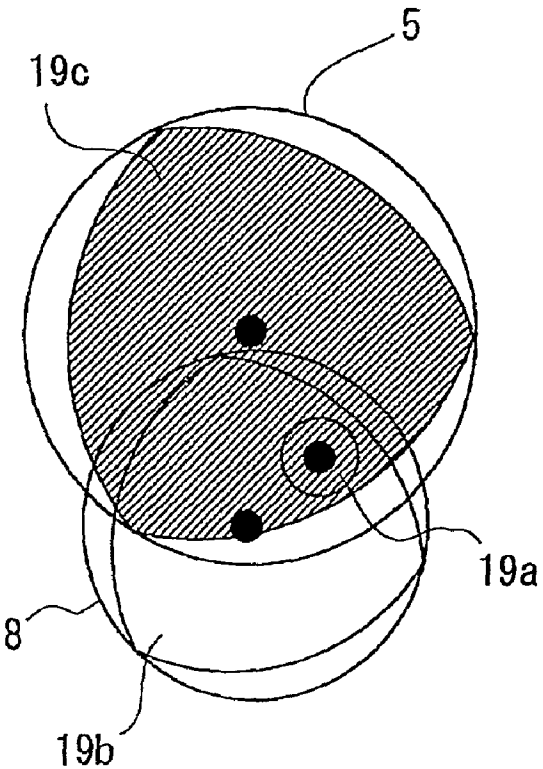

Although the foregoing embodiment is described for the case in which both the cam member and the movable bearing member of the camshaft are circularly shaped, the cam member and the movable bearing member are not restricted to being circular. FIG. 9A to FIG. 9C shows examples in which the cam member and the movable bearing member have other shapes enabling them to be rotatably housed in the cam housing hole and the bearing housing hole.

FIG. 9A shows an example in which the cam member and the movable bearing member described above in the first embodiment have circular outer shapes. FIG. 9B shows an example in which the cam member and the movable bearing member have outer shapes formed by arc-shaped end surfaces and straight-line end surfaces. FIG. 9C shows an example in which the cam member and the movable bearing member have outer shapes that are enclosed by three arcs.

The second embodiment of the present invention will now be described. In the variable compression ratio internal combustion engine of the second embodiment, the line segment L1 joining the centers of the shaft member 9*a* and the cam member 9*b* of the camshaft 9 and the line segment L2 joining the centers of the shaft member 9*a* and the movable bearing member 9*c* are set to be equal. In this configuration in the known art, the change from the minimum compression ratio to the maximum compression ratio within the compression ratio range is performed as shown FIG. 2A through FIG. 2C and FIG. 4A.

In contrast, in this embodiment, in the case of controlling the compression ratio of the internal combustion engine 1 to be the maximum compression ratio, the arrangement is made so that, from the orientation shown in FIG. 2C in which the rotational angle of the camshaft 9 is 90°, the camshaft 9 is further rotated by 90° to a rotational angle of 180°. At this point, the camshaft 9 and the operation of the cylinder block 3 and the crankcase 4 are described for the case of rotating the camshaft 9 an additional 90° from the rotational angle of 90°. A stopper 14 is provided between the cylinder block 3 and the crankcase 4 to prevent both the cylinder block 3 and the crankcase 4 from further approaching each other in maximum compression ratio orientation in which the camshaft rotational angle is 90°. Even if the rotational angle of the camshaft 9 is rotating from 90° by further 90°, the cylinder block 3 and the crankcase 4 do not move further together.

Figure 4C:
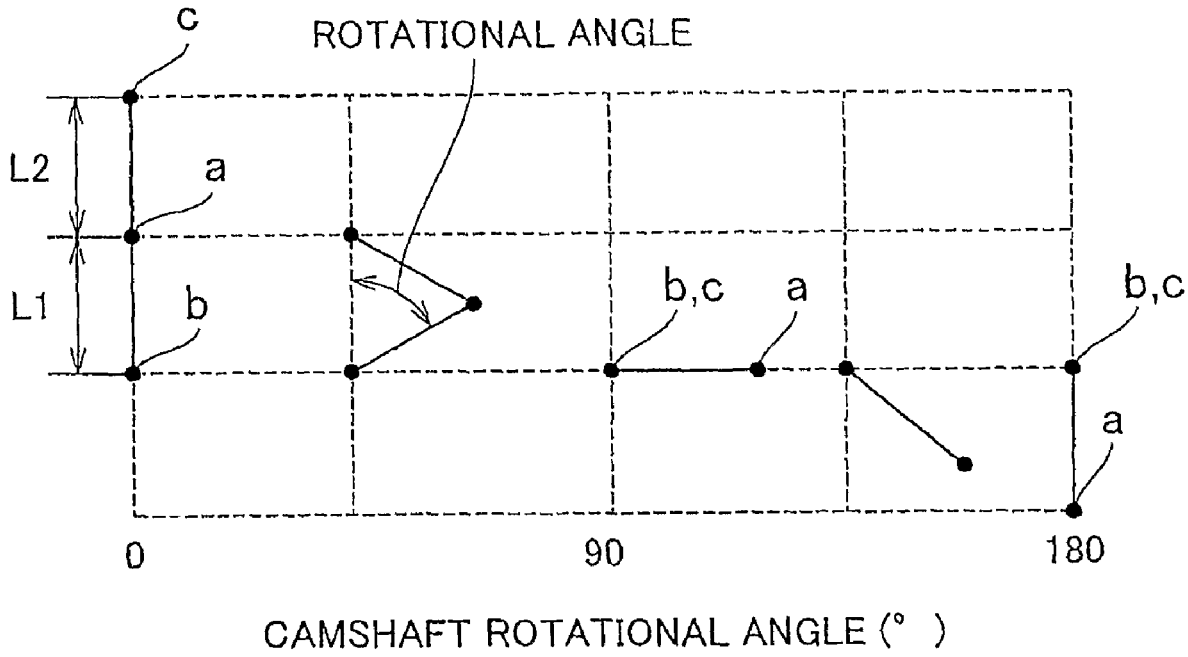
FIG. 4C is a drawing showing the movement of the line segment joining the centers of the shaft member and the cam member and the line segment joining the centers of the shaft member and the movable bearing member, in response to a change in the rotational angle of the camshaft in a variable compression ratio internal combustion engine according to a second embodiment of the present invention.
Figure 10B:
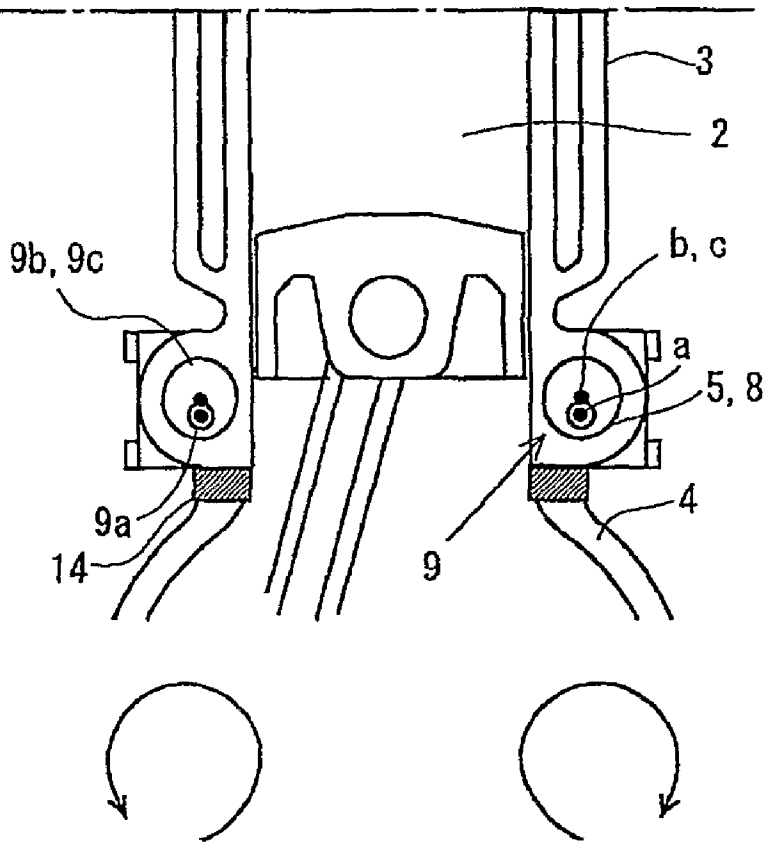
FIG. 10A through FIG. 10B are drawings showing the progression when the camshaft is rotated beyond the orientation in which the compression ratio is maximum in the variable compression ratio internal combustion engine according to the second embodiment of the present invention.
Figure 10A:
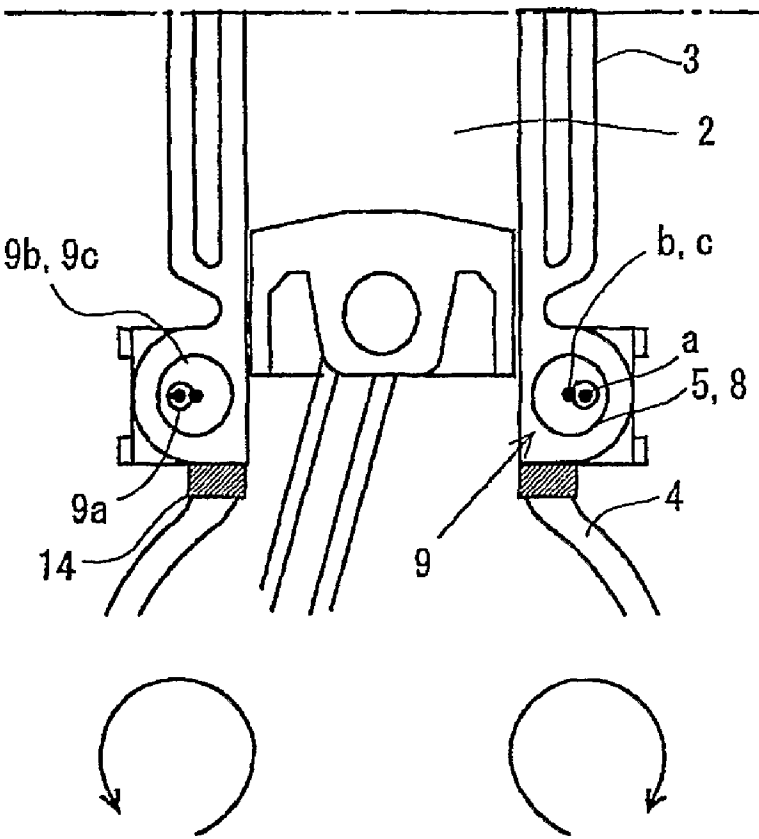

FIG. 10A and FIG. 10B are cross-sectional views showing the relationship between the cylinder block 3, the crankcase 4, and the camshaft 9 assembled therebetween, in the case in which the camshaft 9 in this embodiment is rotated further from the orientation shown in FIG. 2C. FIG. 4C shows the movement of the line segments L1, L2 when this rotation occurs.

The orientation shown in FIG. 10A is the maximum compression ratio orientation within the compression ratio range, this being the same as the orientation shown in FIG. 2C. When the camshaft 9 is rotated further in the direction of the arrow from this orientation, as noted above, because the cylinder block 3 and crankcase 4 do not move further together, the cam member 9*b* and the movable bearing member 9*c* of the camshaft 9 maintain their overlapped orientation as viewed from the axial direction of the camshaft 9, while the camshaft 9 rotates within the bearing housing holes 5 and the cam housing holes 8.

By rotating the camshaft 9 by 90° from the orientation of FIG. 10A, which is the orientation in which the rotational angle is 90° as shown in FIG. 4C, the rotational angle changes to the orientation of 180° as shown in FIG. 10B or FIG. 4C. In this orientation, the line segment L1 and the line segment L2 shown in FIG. 4C are parallel to the axis line of cylinder 2, thereby inhibiting amplification of the load caused by combustion pressure acting in the direction of the line segment L1 and L2. As a result, vibration of the internal combustion engine 1 is suppressed. The action of the large torque caused by combustion pressure on the camshaft 9 is also suppressed.

The orientation shown in FIG. 2A corresponds to the first orientation in this embodiment, and the minimum compression ratio that is the corresponding compression ratio corresponds to the first compression ratio in this embodiment. The orientation shown in FIG. 2C and FIG. 10A corresponds to the second orientation ratio in this embodiment. The maximum compression ratio, which is the corresponding compression ratio, corresponds to the second compression ratio in this embodiment. Additionally, the first controller of this embodiment includes the camshaft 9 that causes the internal combustion engine 1 to transition from the orientation of FIG. 2A to the orientation of FIG. 2C.

The second controller of this embodiment includes the camshaft 9 that causes the internal combustion engine 1 to transition from the orientation of FIG. 10A to the orientation of FIG. 10B, and the stopper 14 corresponds to the prohibiting device.

Figure 11:
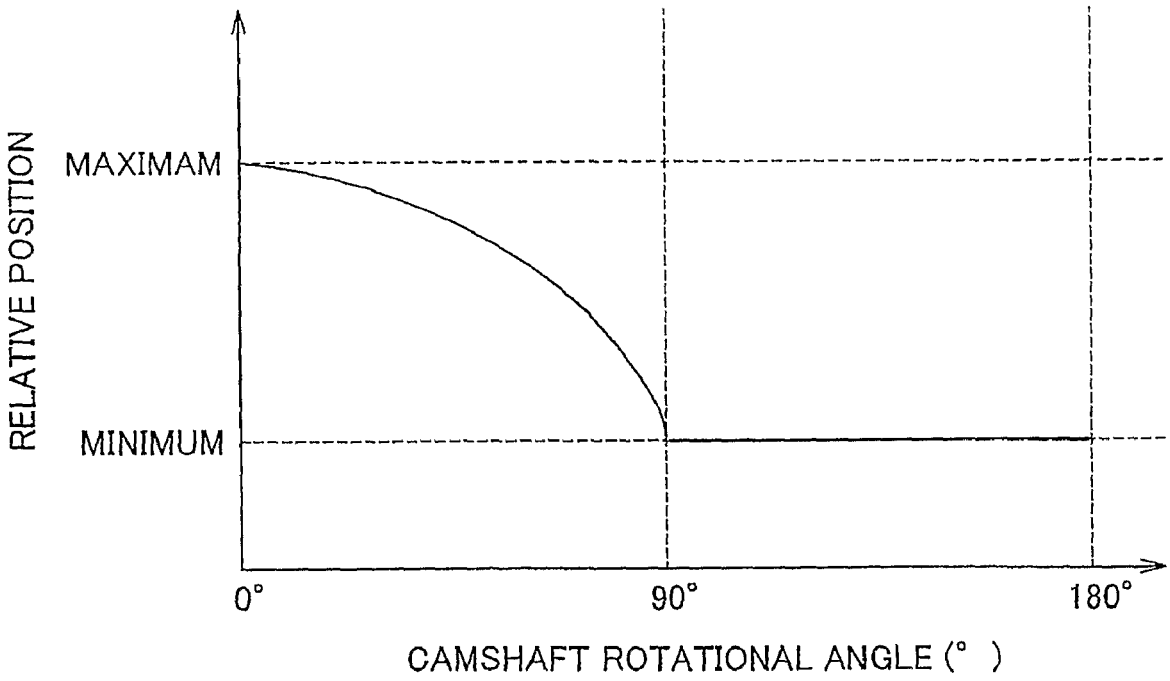
FIG. 11 is a graph showing the relationship between the rotational angle of the camshaft and the relative position between the cylinder block and the crankshaft in the second embodiment of the present invention.

FIG. 11 shows the change in the relative position of the cylinder block 3 with respect to the crankcase 4 when the camshaft 9, the cylinder block 3, and the crankcase 4 change from the orientation of FIG. 2A, passing through the orientation shown FIG. 2C and FIG. 10A, to the orientation of FIG. 10B. In FIG. 11 the horizontal axis represents the rotational angle of the camshaft 9, and the vertical axis represents the relative position of the cylinder block 3 with respect to the crankcase 4. As shown in FIG. 4C, when the rotational angle of the camshaft 9 is 0°, the cylinder block 3 is in the orientation that is farthest away from crankcase 4, the compression ratio in this orientation being the minimum compression ratio in the compression ratio range.

As the camshaft 9 rotates from this orientation, the cylinder block 3 and the crankcase 4 approach one another, and when the rotational angle of the camshaft 9 is 90°, the cylinder block 3 and crankcase 4 are the closest together. The compression ratio in this orientation is the maximum compression ratio in the compression ratio range.

When the camshaft 9 is rotated further from the 90° orientation, because the cylinder block 3 and the crankcase 4 come into contact with the stopper 14, they do not further approach one another, and the camshaft 9 rotates freely in the bearing housing holes 5 and the cam housing holes 8. Even if the rotational angle of the camshaft 9 reaches 180° and the line segment L1 and the line segment L2 parallel to the axis line of the cylinder 2, the distance between the cylinder block 3 and the crankcase 4 is held at the same distance as when the rotational angle of the camshaft 9 is 90°.

As can be seen from FIG. 11, when the rotational angle of the camshaft 9 is in the vicinity of 90°, the amount of change of the relative position of the cylinder block 3 with regard to the crankcase 4 increases for a given change in the rotational angle of the camshaft 9. In this case as described above, the torque and load acting on the camshaft 9 increase. With respect to this, control may be performed so that the frequency of using a camshaft rotational angle in the vicinity of 90°, for example in the range from 85° to 120° is reduced and so that the use of the rotational angle of the camshaft 9 in the vicinity of 90° is not continued for a long period of time. In this case, if the rotational angle of the camshaft 9 corresponding to the target compression ratio is 88°, the rotational angle of the camshaft 9 can be set to 85° instead of 88°. In contrast, if the target compression ratio is the maximum compression ratio, the rotational angle of the camshaft 9 can be made 180° as described above. The rotational angle may also be made sufficiently distant from 90° and may also be less than 180°.

Figure 12:
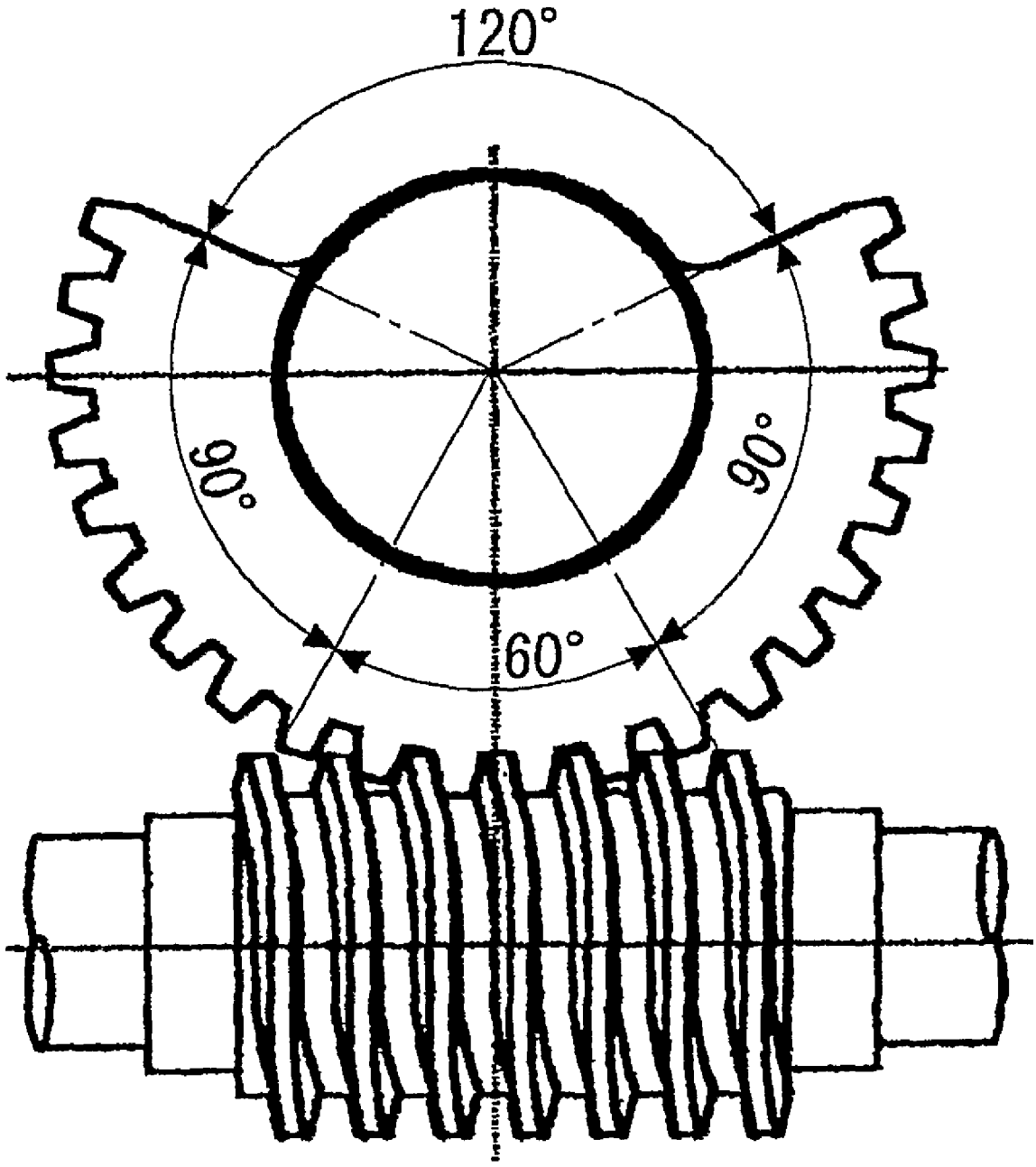
FIG. 12 is a drawing showing an example of gears that can be applied to the second embodiment of the present invention.

As shown in FIG. 1, the gear 10 used in the foregoing description is a circular gear. In contrast, in this embodiment a gear may be used, as shown in FIG. 12, from which an unwanted part is cut away. In this case, as shown in FIG. 12, if the meshing angle with the worm gears 1*a*, 1*b* is made 60°, 90° of rotational leeway is required to vary the compression ratio, and a rotational leeway of 90° is required in order to rotate from the maximum compression ratio orientation to the orientation in which the line segments L1 and L2 are parallel with the axial direction. The angle of the cut away part is, therefore, 120°.

The third embodiment of the present invention will now be described. For this embodiment, the control to change the rotational angle of the camshaft 9 in response to the operating condition of the internal combustion engine 1 while maintaining the orientation of the maximum compression ratio in the compression ratio range will be described.

In this case, the target value of compression ratio of the internal combustion engine 1 is established in accordance with the operating condition thereof. For example, the highest compression ratio at which knocking does not occur at various operating conditions is set as the target value. In this case, there exists a region of operating condition in which the target value is the maximum compression ratio (hereinafter "maximum compression ratio region").

In the case in which the operating condition of the internal combustion engine 1 falls in the maximum compression ratio region, the maximum compression ratio is set as the target value of compression ratio. In the control described for the second embodiment, there are cases in which the rotational angle of the camshaft 9 is made 180°. If this occurs, if the operating condition of the internal combustion engine 1 subsequently leaves the maximum compression ratio region, it is necessary to rotate the camshaft 9 to first bring the rotational angle of the camshaft 9 from 180° to 90°, and then further rotate the camshaft 9 to the rotational angle corresponding to the compression ratio responsive to the operating condition at that point in time. By doing this, the time required to changing from the maximum compression ratio to a lower compression ratio increases, and there are cases in which it is difficult to quickly change the compression ratio. As a result, a case can be envisioned in which it is not possible to sufficiently suppress knocking.

Given the above, in this embodiment the maximum compression ratio region in the operating condition of the internal combustion engine 1 is divided in to a plurality of sub-regions, and the closer the operating condition of the internal combustion engine 1 approaches to the boarder with another operating condition sub-region within the maximum compression ratio region, the closer the rotational angle of the camshaft 9 is made to 90°.

Figure 13:
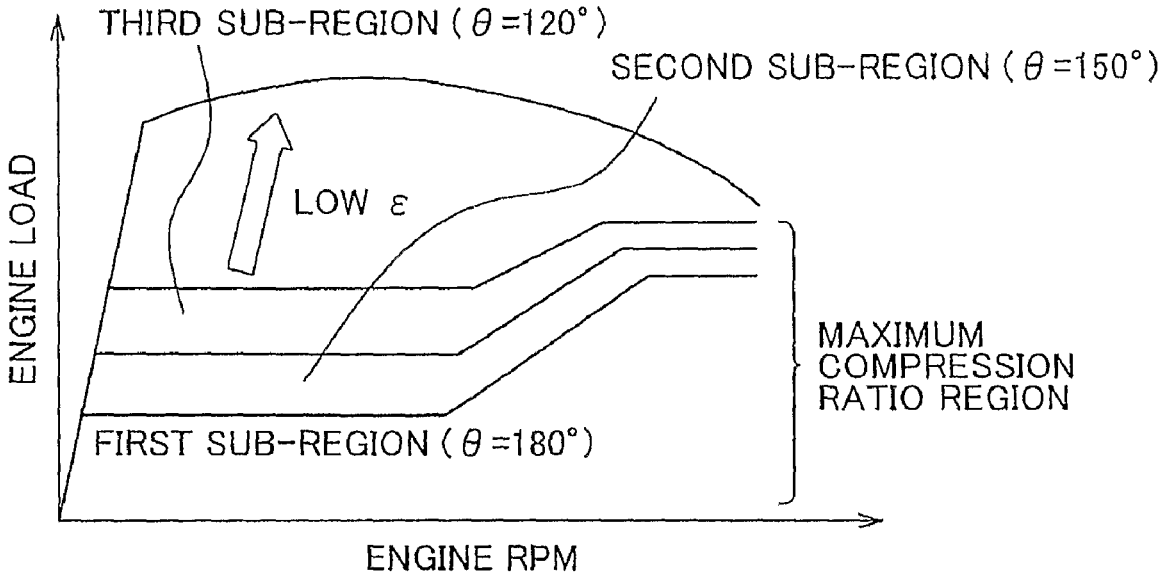
FIG. 13 is a graph showing the relationship between the operating condition and the rotational angle of the camshaft in a third embodiment of the present invention.

FIG. 13 is a graph showing the relationship between the operating condition of the internal combustion engine 1 and the rotational angle of the camshaft 9 in this embodiment. As shown in FIG. 13, of the operating conditions that the internal combustion engine 1 can be set, in a region on the low-load side, the maximum compression ratio is set as the target value of the compression ratio. This region is above-described maximum compression ratio region. Then, when the engine load crosses over the border of the maximum compression ratio region, the target value of the compression ratio is set to a lower compression ratio to suppress the occurrence of knocking.

As shown in FIG. 13, in this embodiment the maximum compression ratio region is further divided into three sub-regions, from the first to the third sub-regions. In the first sub-region, in which the engine load is lowest, the rotational angle of the camshaft 9 is set to 180°, in the second sub-region, in which the engine load is somewhat higher, the rotational angle of the camshaft 9 is set to 150°, and in the third sub-region, in which the engine load is yet higher, the rotational angle of the camshaft 9 is set to 120°. That is, if the operating condition of the internal combustion engine 1 falls in the maximum compression ratio region, the closer the operating condition of the internal combustion engine 1 is to the border between the maximum compression ratio region and another operating region, the closer the rotational angle of the camshaft 9 is made to 90°.

By doing this, the greater is the probability that the target compression ratio is a smaller compression ratio than the maximum compression ratio, the closer it is possible to make the rotational angle of the camshaft 9 to 90°, and the more quickly it is possible to change the compression ratio to a target compression ratio that is lower than the maximum compression ratio. As a result, the tracking of the actual compression ratio to the target compression ratio is improved.

In the above, the orientation in which the camshaft 9 is rotated to a rotational angle greater than 90°, for example, an operating condition falling a sub-region from the first sub-region to the third sub-region, corresponds to the third orientation in this embodiment. The above-noted maximum compression ratio region corresponds to the second compression ratio region in this embodiment.

Next, a fourth embodiment of the present invention will be described. In this embodiment, in the same manner as in the third embodiment, in the case in which the operating condition of the internal combustion engine 1 falls in the maximum compression ratio region, control to improve the tracking of the compression ratio when the target compression ratio becomes lower than the maximum compression ratio, which is control to change the rotational angle of the camshaft 9 in accordance with the rate at which the operating condition changes in the internal combustion engine 1, will be described.

Figure 14:
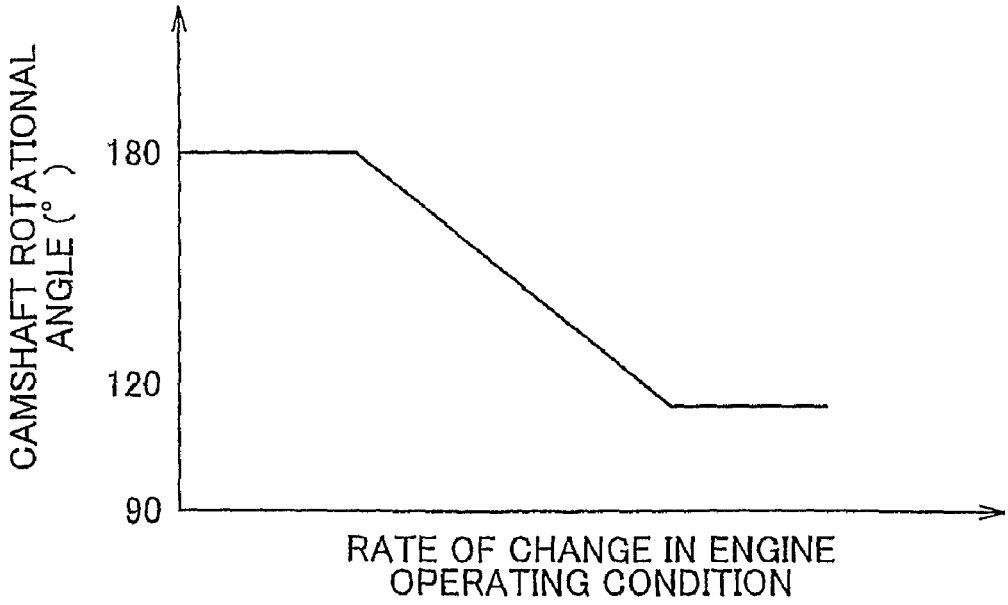
FIG. 14 is a graph showing the relationship between the rate at which the operating condition changes and the rotational angle of the camshaft in a fourth embodiment of the present invention.

That is, in this embodiment when the operating condition of the internal combustion engine 1 falls within the maximum compression ratio region, a prediction is made that the operating condition is likely to shortly leave the maximum compression ratio region if the rate at which the operating condition changes is large. FIG. 14 is a graph showing the relationship between the rate at which the operating condition changes and the rotational angle of the camshaft 9 in this embodiment.

In FIG. 14, the vertical axis represents the rotational angle of the camshaft 9, and the horizontal axis represents the rate at which the operating condition changes. The rate at which the operating condition changes may be predicted by the time derivative $d\phi/dt$, which represents the rate of change of the throttle opening signal $\phi$. As shown in FIG. 14, even if the operating condition of the internal combustion engine 1 falls within the maximum compression ratio region, if the rate at which the operating condition changes is great, it is determined in this embodiment that there is a large possibility that the operating condition will leave the maximum compression ratio region, and the rotational angle of the camshaft 9 is changed accordingly to approach 90°.

By doing this, in a condition in which the rate at which the operating condition changes is high, it is possible to prepare to change the compression ratio to be lower than the maximum compression ratio by making the rotational angle of the camshaft 9 smaller than 90°, thereby improving the tracking of the actual compression ratio to the target compression ratio. In the above, although the rate at which the operating condition changes is predicted by $d\phi/dt$, which represents the rate of change of the throttle opening signal $\phi$ with respect to time, this may alternatively be predicted by dN/dt, which represents the rate of change of the engine rpm N with respect to time, in accordance with a signal from a crankshaft position sensor (not shown).

The foregoing embodiments are described for a configuration in which the cylinder block 3 and the crankcase 4 are brought together by increasing the rotational angle of the camshaft 9 from 0° to 90°. However, the present invention may also be applied to a reverse configuration in which, in the orientation in which the cylinder block 3 and the crankcase 4 are closest together, the center c of the movable bearing member 9*c*, the center a of the shaft member 9*a*, and the center b of the cam member 9*b* are aligned in the stated order, substantially in parallel with the axial direction of the cylinder 2, and substantially along a straight line. This is the case in which, when the cylinder block 3 and the crankcase 4 are farthest from one another, the center c of the movable bearing member 9*c* and the center b of the cam member 9*b* are superposed, and the center c of the movable bearing member 9*c*, the center b of the cam member 9*b*, and the center a of the shaft member 9*a* are aligned in a direction substantially perpendicular to the axial direction of the cylinder 2. In this case, the maximum compression ratio corresponds to the first compression ratio and the minimum compression ratio corresponding to the second compression ratio.

The invention claimed is:

1. A variable compression ratio internal combustion engine, comprising:

a crankcase into which a crankshaft is assembled;

a cylinder block in which a cylinder is formed and that is movably mounted on the crankcase; and camshafts disposed on two sides of the cylinder in the cylinder block so as to be rotatable in mutually opposite directions, wherein the camshafts include a shaft member, a cam member fixed to the shaft member, and a movable bearing member rotatably mounted on the shaft member, the cam member being rotatably housed in a cam housing hole, formed in one of the cylinder block and the crankcase, and the movable bearing member being rotatably housed in a bearing housing hole, formed in the other of the cylinder block and the crankcase, the camshafts are rotated to move the crankcase and the cylinder block toward or away from each other to change a compression ratio of the internal combustion engine, and as viewed from an axial direction of the camshaft, a length of a line segment joining a center of the shaft member, which is a center of rotation of the shaft member, and a center of the movable bearing member, which is a center of rotation of the movable bearing member within the bearing housing hole, is set longer than a length of a cam operating line segment, which is a straight line joining centers of the shaft member and the cam member, wherein a center of the cam member is a center of rotation of the cam member within the cam housing hole.

2. The variable compression ratio internal combustion engine according to claim 1, wherein a minimum compression ratio in a compression ratio range is obtained when an orientation of centers of the movable bearing member, the shaft member, and the cam member of the camshaft, as viewed from the axial direction of the camshaft, are aligned in the stated order in a substantially straight line that is substantially parallel to the axial direction of the cylinder;

a maximum compression ratio in the compression ratio range is obtained when the orientation of the centers of the movable bearing member, the cam member, and the shaft member, as viewed from the axial direction of the camshaft, are aligned in the stated order in a substantially straight line that is substantially parallel to the axial direction of the cylinder; and the maximum compression ratio is obtained by rotating the camshaft substantially 180° from the orientation in which the minimum compression ratio is obtained.

3. The variable compression ratio internal combustion engine according to claim 1, wherein a maximum compression ratio in a compression ratio range is obtained when an orientation of centers of the movable bearing member, the shaft member, and the cam member of the camshaft, as viewed from the axial direction of the camshaft, are aligned in the stated order in a substantially straight line that is substantially parallel to the axial direction of the cylinder;

a minimum compression ratio in the compression ratio range is obtained when the orientation of the centers of the movable bearing member, the cam member, and the shaft member, as viewed from the axial direction of the camshaft, are aligned in the stated order in a substantially straight line that is substantially parallel to the axial direction of the cylinder; and the minimum compression ratio is obtained by rotating the camshaft substantially 180° from the orientation in which the maximum compression ratio is obtained.

4. The variable compression ratio internal combustion engine according to claim 2, wherein, when the camshaft is rotated substantially 90° from the orientation in which either the minimum compression ratio or the maximum compression ratio is obtained, the ratio of the length of the movable bearing member operating line segment to the length of the cam operating line segment is set so that the compression ratio is a median value of the compression ratio range.

5. The variable compression ratio internal combustion engine according to claim 1, wherein the ratio of the length of the movable bearing member operating line segment to the length of the cam operating line segment is 1.3 or greater.

6. The variable compression ratio internal combustion engine according to claim 1, wherein the shaft member has a cylindrical shape and the cam member, as viewed from the axial direction of the camshaft, is eccentric with respect to the center of the shaft member and has a circular cam profile with a diameter greater than that of the shaft member, and wherein the cam housing hole has the same circular shape as the cam member, the outer diameter of the movable bearing member is larger than the diameter of the cam member, and the bearing housing hole has the same circular shape as the movable bearing member.

7. The variable compression ratio internal combustion engine according to claim 1, wherein the frequency of use of a prescribed first angle range, which is in the vicinity of 60° rotation of the camshaft from the orientation in which the centers of the movable bearing member, the shaft member, and the cam member of the camshaft, as viewed from the axial direction of the camshaft, are aligned in the stated order in a substantially straight line that is substantially parallel to the cylinder, and/or the frequency of use of a prescribed second angle range, which is in the vicinity of 90° rotation of the camshaft from the same orientation is lower than any other possible angle ranges.

8. A variable compression ratio internal combustion engine, comprising:

a crankcase into which a crankshaft is assembled;

a cylinder block in which a cylinder is formed and that is movably mounted on the crankcase; and camshafts disposed in parallel with each other on two sides of the cylinder in the cylinder block so as to be rotatable in mutually opposite directions wherein the camshafts include a shaft member, a cam member fixed to the shaft member, and a movable bearing member rotatably mounted on the shaft member, the cam member being rotatably housed in a cam housing hole, formed in one of the cylinder block and the crankcase, and the movable bearing member being rotatably housed in a bearing housing hole, formed in the other of the cylinder block and the crankcase, the camshafts are rotated to move the crankcase and the cylinder block toward or away from each other to change a compression ratio of the internal combustion engine, the internal combustion engine has a first compression ratio that is obtained when an orientation of centers of the movable bearing member, the shaft member, and the cam member of the camshaft, as viewed from an axial direction of the camshaft, are aligned in the stated order in a substantially straight line that is substantially parallel to an axial direction of the cylinder, and a third compression ratio is obtained when the orientation of the centers of the movable bearing member, the cam member and the shaft member, as viewed from the axial direction of the camshaft, are substantially aligned in a straight line that is substantially parallel to the axial direction of the cylinder in the order that a center of the movable bearing member is disposed after a center of the cam member, and the third compression ratio is obtained by rotating the camshaft substantially 180° from orientation in which the first compression ratio is obtained, and wherein one of the first compression ratio and the third compression ratio is set as a minimum compression ratio of a compression ratio range, and the other of the first compression ratio and the third compression ratio is taken as a maximum compression ratio of the compression ratio range.

9. The variable compression ratio internal combustion engine according to claim 8, wherein, as viewed from the axial direction of the camshaft, a length of a line segment joining a center of the shaft member, which is a center of rotation of the shaft member, and a center of the movable bearing member, which is a center of rotation of the movable bearing member within the bearing housing hole, is set longer than a length of a cam operating line segment, which is a straight line joining the centers of the shaft member and the cam member, wherein a center of the cam member is a center of rotation of the cam member within the cam housing hole.

10. The variable compression ratio internal combustion engine according to claim 9, wherein the maximum compression ratio in the compression ratio range is obtained when an orientation of the centers of the movable bearing member, the shaft member, and the cam member of the camshaft, as viewed from the axial direction of the camshaft, are aligned in the stated order in a substantially straight line that is substantially parallel to the axial direction of the cylinder;

the minimum compression ratio in the compression ratio range is obtained when the orientation of the centers of the movable bearing member, the cam, and the shaft member, as viewed from the axial direction of the camshaft, are aligned in the stated order in a substantially straight line that is substantially parallel to the axial direction of the cylinder; and the minimum compression ratio is obtained by rotating the camshaft substantially 180° from the orientation in which the maximum compression ratio is obtained.

11. The variable compression ratio internal combustion engine according to claim 9, wherein, when the camshaft is rotated substantially 90° from the orientation in which either the minimum compression ratio or the maximum compression ratio is obtained, the ratio of the length of the movable bearing member operating line segment to the length of the cam operating line segment is set so that the compression ratio is a median value of the compression ratio range.

12. The variable compression ratio internal combustion engine according to claim 9, wherein the ratio of the length of the movable bearing member operating line segment to the length of the cam operating line segment is 1.3 or greater.

13. The variable compression ratio internal combustion engine according to claim 8, wherein the shaft member has a cylindrical shape and the cam member, as viewed from the axial direction of the camshaft, is eccentric with respect to the center of the shaft member and has a circular cam profile with a diameter greater than that of the shaft member, and wherein the cam housing hole has the same circular shape as the cam member, the outer diameter of the movable bearing member that is larger than the diameter of the cam member, and the bearing housing hole has the same circular shape as the movable bearing member.

14. The variable compression ratio internal combustion engine according to claim 8, wherein the frequency of use of a prescribed first angle range, which is in the vicinity of 60° rotation of the camshaft from the orientation in which the centers of the movable bearing member, the shaft member, and the cam member of the camshaft, as viewed from the axial direction of the camshaft, are aligned in the stated order in a substantially straight line that is substantially parallel to the cylinder, and/or the frequency of use of a prescribed second angle range, which is in the vicinity of 90° rotation of the camshaft from the same orientation is lower than any other possible angle ranges.

15. The variable compression ratio internal combustion engine according to claim 8, wherein the shaft member has a cylindrical shape and the cam member, as viewed from the axial direction of the camshaft, is eccentric with respect to the center of the shaft member and has a circular cam profile with a diameter greater than that of the shaft member, and wherein the cam housing hole has the same circular shape as the cam member, the outer diameter of the movable bearing member is the same as the cam, and the bearing housing hole has the same circular shape as the movable bearing member, the variable compression ratio internal combustion engine further comprising:

a first controller that controls the compression ratio by rotating the camshaft between a first orientation, in which, as viewed from the axial direction of the camshaft, the centers of the movable bearing member, the shaft member, and the cam member of the camshaft are aligned in the stated order in a substantially straight line that is substantially parallel to the axial direction of the cylinder, and a second orientation, in which, as viewed from the axial direction of the camshaft, the centers of the movable bearing member and the cam member are superposed and the centers of the movable bearing member, the cam, and the shaft member are aligned substantially perpendicular to the axial direction of the cylinder, wherein the second orientation is obtained by rotating the camshaft 90° from the first orientation, to control the compression ratio between the first compression ratio, obtained in the first orientation, and a second compression ratio, obtained in the second orientation; and a second controller that rotates the camshaft from the second orientation further in a direction away from the first orientation while maintaining the compression ratio at the second compression ratio and maintaining the superposition of the centers of the movable bearing member and the cam member.

16. The variable compression ratio internal combustion engine according to claim 15, wherein the second controller has a prohibiting device that, when rotating the camshaft from the second orientation in the direction away from the first orientation, prohibits further movement of the cylinder block either towards or away from the crankcase.

17. The variable compression ratio internal combustion engine according to claim 15, wherein the first compression ratio is the minimum compression ratio in the compression ratio range of the internal combustion engine, and the second compression ratio is the maximum compression ratio in the compression ratio range of the internal combustion engine.

18. The variable compression ratio internal combustion engine according to claim 15, wherein the first compression ratio is the maximum compression ratio in the compression ratio range of the internal combustion engine, and the second compression ratio is the minimum compression ratio in the compression ratio range of the internal combustion engine.

19. The variable compression ratio internal combustion engine according to claim 15, wherein when the compression ratio is changed to the second compression ratio as a target compression ratio, the first controller sets the camshaft to the second orientation to obtain the second compression ratio, and the second controller rotates the camshaft by substantially 90° beyond the second orientation in the direction away from the first orientation.

20. The variable compression ratio internal combustion engine according to claim 15, wherein when the variable compression ratio internal combustion engine is idling and the compression ratio is the second compression ratio, the second controller rotates the camshaft by substantially 90° beyond the second orientation in the direction away from the first orientation.

21. The variable compression ratio internal combustion engine according to claim 15, wherein when an operating condition of the variable compression ratio internal combustion engine falls in a prescribed second compression ratio region, the second compression ratio is set as a target compression ratio, when the operating condition falls in another compression ratio region, the compression ratio is changed from the second compression ratio, and when the second compression ratio is set as the target compression ratio, the first controller sets the camshaft to the second orientation to obtain the second compression ratio and the second controller rotates the camshaft beyond the second orientation in the direction away from the first orientation to a third orientation, and the second controller causes the angle of the camshaft in the third orientation to approach the angle of the second orientation, as the operating condition approaches the border between the second compression ratio region and the other compression ratio region.

22. The variable compression ratio internal combustion engine according to claim 15, wherein when an operating condition of the variable compression ratio internal combustion engine falls in a prescribed second compression ratio region, the second compression ratio is set as a target compression ratio, when the operating condition falls in another compression ratio region, the compression ratio is changed from the second compression ratio, and when the second compression ratio is set as the target compression ratio, the first controller sets the camshaft to the second orientation to obtain the second compression ratio and the second controller rotates the camshaft beyond the second orientation in the direction away from the first orientation to a third orientation, and the second controller causes the angle of the camshaft in the third orientation to approach the angle of the second orientation, as the rate at which the operating condition changes increases when the operating condition falls in the second compression ratio region.

23. The variable compression ratio internal combustion engine according to claim 22, wherein the rate at which the operating condition changes is determined based on at least one of the engine load and the engine speed.

* * * * *